US008928440B2

(12) United States Patent
Matsumoto et al.

(10) Patent No.: US 8,928,440 B2
(45) Date of Patent: Jan. 6, 2015

(54) LINEAR SOLENOID

(71) Applicant: Denso Corporation, Kariya, Aichi-pref. (JP)

(72) Inventors: Koichiro Matsumoto, Nagoya (JP); Yoshiyuki Murao, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/954,167

(22) Filed: Jul. 30, 2013

(65) Prior Publication Data

US 2014/0028423 A1 Jan. 30, 2014

(30) Foreign Application Priority Data

Jul. 30, 2012 (JP) ..... 2012-168202
Jul. 30, 2012 (JP) ..... 2012-168203
Jul. 30, 2012 (JP) ..... 2012-168204

(51) Int. Cl.
*H01F 7/16* (2006.01)
*H01F 7/08* (2006.01)

(52) U.S. Cl.
CPC ..... *H01F 7/1607* (2013.01); *H01F 2007/085* (2013.01)
USPC ..... 335/282; 335/220

(58) Field of Classification Search
CPC ..... H01F 7/1607; H01F 2007/085; H01F 2007/163; H01F 7/127
USPC ..... 335/220–229, 281, 282
See application file for complete search history.

(56) References Cited

U.S. PATENT DOCUMENTS

| | | | |
|---|---|---|---|
| 5,268,662 | A | 12/1993 | Uetsuhara et al. |
| 5,356,578 | A | 10/1994 | Isomura et al. |
| 6,328,276 | B1 | 12/2001 | Falch et al. |
| 2003/0047699 | A1 | 3/2003 | Sakata et al. |
| 2004/0257185 | A1 | 12/2004 | Telep |
| 2005/0211938 | A1 | 9/2005 | Ryuen et al. |

(Continued)

FOREIGN PATENT DOCUMENTS

| | | |
|---|---|---|
| DE | 10 2006 015233 | 10/2007 |
| JP | S61-077312 | 9/1984 |
| JP | H07-317940 | 12/1995 |
| JP | 2009-044924 | 2/2009 |

OTHER PUBLICATIONS

Matsumoto, et al., U.S. Appl. No. 13/954,163, filed Jul. 30, 2013.

(Continued)

*Primary Examiner* — Bernard Rojas
(74) *Attorney, Agent, or Firm* — Nixon & Vanderhye P.C.

(57) ABSTRACT

One axial end of a through-hole of a bearing portion of a first stationary core located on a movable core side has a peripheral edge placed at a corresponding axial position. The corresponding axial position of the peripheral edge may be the same as an axial position of an axial end surface of a radially outer part of the first stationary core or is on an axial side of the axial end surface, which is axially opposite from the movable core. A bottom portion of a yoke may have a hole, which receives at least a part of a second stationary core. A stopper made of a resin material may be placed on a side of the bottom portion of the yoke, which is opposite from the second stationary core in the axial direction. A shaft may be abuttable against the stopper.

30 Claims, 26 Drawing Sheets

(56) References Cited

U.S. PATENT DOCUMENTS

| | | | | |
|---|---|---|---|---|
| 2009/0039992 | A1* | 2/2009 | Ryuen et al. | 335/255 |
| 2011/0073791 | A1 | 3/2011 | Oikawa | |
| 2011/0220826 | A1 | 9/2011 | Hoppe et al. | |
| 2011/0248805 | A1 | 10/2011 | Hamaoka et al. | |
| 2011/0255888 | A1 | 10/2011 | Itoyama et al. | |
| 2014/0026836 | A1* | 1/2014 | Matsumoto et al. | 123/90.15 |
| 2014/0028422 | A1* | 1/2014 | Matsumoto et al. | 335/282 |

OTHER PUBLICATIONS

Matsumoto, et al., U.S. Appl. No. 13/954,171, filed Jul. 30, 2013.
Japanese Office Action issued for Japanese Patent Application No. 2012-168202, dated Jun. 27, 2014.
Japanese Office Action issued for Japanese Patent Application No. 2012-168203, dated Jul. 8, 2014.
Japanese Office Action issued for Japanese Patent Application No. 2012-168204, dated Jul. 8, 2014.

* cited by examiner

LINEAR SOLENOID

CROSS REFERENCE TO RELATED APPLICATION

This application is based on and incorporates herein by reference Japanese Patent Application No. 2012-168202 filed on Jul. 30, 2012, Japanese Patent Application No. 2012-168203 filed on Jul. 30, 2012 and Japanese Patent Application No. 2012-168204 filed on Jul. 30, 2012.

TECHNICAL FIELD

The present disclosure relates to a linear solenoid.

BACKGROUND

A known linear solenoid linearly drives a movable core through use of a magnetic field that is generated upon energization of a coil of a stator. For example, JP2011-222799A (US2011/0248805A1) discloses a linear solenoid that has a shaft supported by a first stationary core and a second stationary core. The second stationary core includes a bearing portion, a magnetic flux conducting portion (also referred to as an outer tubular portion) and a connecting portion. The bearing portion slidably supports the shaft. The magnetic flux conducting portion is placed on an outer side of the bearing portion in a radial direction and forms an air gap between the magnetic flux conducting portion and the first stationary core in the axial direction. The connecting portion connects between an end part of the magnetic flux conducting portion and an end part of the bearing portion on an axial side, which is axially opposite from the first stationary core.

The movable core includes a holding portion and a magnetic flux conducting portion. The holding portion securely holds the shaft at a corresponding location, which is located between the first stationary core and the second stationary core in the axial direction. The magnetic flux conducting portion of the movable core axially extends from the holding portion at a radial location between the bearing portion of the second stationary core and the magnetic flux conducting portion of the second stationary core. When the coil is energized, the movable core is moved by a magnetic attractive force toward the first stationary core. An axial extent of an overlapped area between the magnetic flux conducting portion of the movable core and the bearing portion of the second stationary core progressively decreases when the movable core is moved toward the first stationary core. In this overlapped area, an axial extent of the magnetic flux conducting portion of the movable core and an axial extent of the bearing portion of the second stationary core are overlapped with each other, and an axial extent of this overlapped area is referred to as the axial extent of the overlapped area.

At the time of energizing the coil, a magnetic attractive force is also exerted from the second stationary core to the movable core to axially attract the movable core toward the second stationary core besides the magnetic attractive force exerted to the movable core to axially attract the movable core toward the first stationary core. The magnetic attractive force, which attracts the movable core toward the second stationary core, is increased when a density of the magnetic flux, which is conducted between the magnetic flux conducting portion of the movable core and the bearing portion of the second stationary core, is increased in response to the decrease in the axial extent of the overlapped area between the magnetic flux conducting portion of the movable core and the bearing portion of the second stationary core. Particularly, the magnetic attractive force, which attracts the movable core toward the second stationary core, is rapidly increased in a latter half of a stroke of the movable core from the second stationary core side (i.e., an initial position) toward the first stationary core side (i.e., a full stroke position). Therefore, the total magnetic attractive force, which is exerted on the movable core, is largely changed in response to the amount of stroke of the movable core.

In order to address the above disadvantage, it is conceivable to lengthen the magnetic flux conducting portion of the movable core and the bearing portion of the second stationary core toward the first stationary core side and to displace the axial position of the first stationary core in such a manner that a sufficient air gap is provided between the first stationary core and the second stationary core. Thereby, the axial extent of the overlapped area between the magnetic flux conducting portion of the movable core and the bearing portion of the second stationary core can be increased. However, this will result in a disadvantageous increase in the size of the linear solenoid.

In JP2011-222799A (US2011/0248805A1), the shaft is configured to reciprocate in the axial direction between the initial position, which is located on the side where the second stationary core is placed, and the full stroke position, which is located on the side where the first stationary core is placed. When the shaft is placed in the initial position, the shaft contacts a yoke made of a metal material. In JP2011-222799A (US2011/0248805A1), the linear solenoid is used as a drive device of a hydraulic pressure change valve of a valve timing control apparatus of an internal combustion engine.

In a state where a magnetic attractive force is not exerted to the movable core, or the magnetic attractive force exerted to the movable core is relatively small, the shaft is driven by an external force or vibration to the initial position to collide against the yoke, thereby resulting in generation of metal collision sound. In the case of the linear solenoid used in the valve timing control apparatus of the engine recited in JP2011-222799A (US2011/0248805A1), at the time of a cranking operation of the engine or at the time of a cleaning operation of the hydraulic pressure change valve of the valve timing control apparatus, when the shaft is moved by the external force or the vibration toward the initial position, the shaft abuts against the yoke to generate the metal collision sound. Particularly, in the case where the cleaning operation of the hydraulic pressure change valve is performed in a state where an engine load is small, a user of the vehicle can clearly hear the above-discussed metal collision sound due to a low level of the engine noise.

SUMMARY

The present disclosure addresses the above disadvantages.

According to the present disclosure, there is provided a linear solenoid, which includes a coil, a shaft, a first stationary core, a second stationary core, a yoke and a movable core. The coil is formed into an annular form. The shaft is placed on an inner side of the coil in a radial direction and is configured to reciprocate in an axial direction. The first stationary core includes a first bearing portion and a fixing portion. The first bearing portion slidably supports one end portion of the shaft. The fixing portion outwardly extends from the first bearing portion in the radial direction. The second stationary core includes a second bearing portion, an magnetic flux conducting portion and a connecting portion. The second bearing portion slidably supports the other end portion of the shaft that is opposite from the one end portion of the shaft in the axial direction. The magnetic flux conducting portion is configured into a tubular form and is placed between the second bearing portion and the coil in the radial direction. An air gap is interposed between the magnetic flux conducting portion and the first stationary core in the axial direction. The connecting portion connects between one end part of the second bearing portion and one end part of the magnetic flux conducting portion on an axial side that is opposite from the first stationary core in the axial direction. The yoke is located on an outer side of the coil in the radial direction and magnetically couples between the first stationary core and the second stationary core. The movable core includes a housing and a magnetic flux conducting portion. The holding portion securely holds the shaft at a corresponding location that is located between the first bearing portion and the second bearing portion in the axial direction. The magnetic flux conducting portion of the movable core is placed between the second bearing portion and the magnetic flux conducting portion of the second stationary core in the radial direction and extends from the holding portion in the axial direction toward the connecting portion of the second stationary core. When the coil is energized, the movable core is moved toward the first stationary core and conducts a magnetic flux between the first stationary core and the second stationary core through the movable core. A radially outer part of the first bearing portion has an axial end surface, which is placed on the movable core side in the axial direction to axially oppose the movable core. The first bearing portion has a through-hole, which receives the shaft. One axial end of the through-hole of the first bearing portion, which is located on the movable core side, has a peripheral edge that is placed at a corresponding axial position. The corresponding axial position of the peripheral edge of the axial end of the through-hole is the same as an axial position of the axial end surface of the radially outer part or is on an axial side of the axial end surface of the radially outer part, which is opposite from the movable core in the axial direction.

According to the present disclosure, there is also provided a linear solenoid, which includes a coil, a first stationary core, a second stationary core, a yoke, a shaft, a movable core and a non-magnetic member. The coil is formed into an annular form. The first stationary core is placed on one side of the coil in an axial direction. The second stationary core is placed on the other side of the coil, which is opposite from the one side of the coil in the axial direction. An air gap is interposed between the first stationary core and the second stationary core in the axial direction. The yoke is located on an outer side of the coil in a radial direction and magnetically couples between the first stationary core and the second stationary core. The shaft is placed on an inner side of the air gap in the radial direction and is slidably supported by the first stationary core and the second stationary core. The shaft is configured to reciprocate in the axial direction between an initial position, which is located on a side where the second stationary core is placed, and a full stroke position, which is located on a side where the first stationary core is placed. The movable core is fixed to the shaft at a corresponding location, which is located between the first stationary core and the second stationary core in the axial direction. When the coil is energized, the movable core is moved together with the shaft in the axial direction toward the full stroke position to a position located on the inner side of the air gap in the radial direction and conducts a magnetic flux between the first stationary core and the second stationary core through the movable core. The non-magnetic member is held between the first stationary core and the second stationary core and limits relative movement between the first stationary core and the second stationary core toward each other. The yoke includes a tubular portion and a bottom portion. The tubular portion is placed on an outer side of the coil in the radial direction and securely holds the first stationary core. The bottom portion is formed integrally with one end part of the tubular portion, which is located on an axial side where the second stationary core is located. The bottom portion has a hole, which receives at least a part of the second stationary core.

According to the present disclosure, there is also provided a linear solenoid, which includes a coil, a first stationary core, a second stationary core, a yoke, a shaft, a movable core and a stopper. The coil is formed into an annular form. The first stationary core is placed on one side of the coil in an axial direction. The second stationary core is placed on the other side of the coil, which is opposite from the one side of the coil in the axial direction. An air gap is interposed between the first stationary core and the second stationary core in the axial direction. The yoke magnetically couples between the first stationary core and the second stationary core. The yoke includes a tubular portion, which is located on an outer side of the coil in a radial direction, and a bottom portion, which is formed integrally with one end part of the tubular portion located on a side where the second stationary core is placed. The shaft is placed on an inner side of the air gap in the radial direction and is slidably supported by the first stationary core and the second stationary core. The shaft is configured to reciprocate in the axial direction between an initial position, which is located on a side where the second stationary core is placed, and a full stroke position, which is located on a side where the first stationary core is placed. The movable core is fixed to the shaft at a corresponding location, which is located between the first stationary core and the second stationary core in the axial direction. When the coil is energized, the movable core is moved together with the shaft in the axial direction toward the full stroke position to a position located on the inner side of the air gap in the radial direction and conducts a magnetic flux between the first stationary core and the second stationary core through the movable core. The bottom portion of the yoke has a through-hole that has a cross-sectional area, which is larger than a surface area of an end surface of the shaft located on a side where the bottom portion is placed. The stopper is made of a resin material and is placed on a side of the bottom portion of the yoke, which is opposite from the second stationary core in the axial direction. The shaft is abuttable against the stopper.

BRIEF DESCRIPTION OF THE DRAWINGS

The drawings described herein are for illustration purposes only and are not intended to limit the scope of the present disclosure in any way.

DETAILED DESCRIPTION

Figure 1:
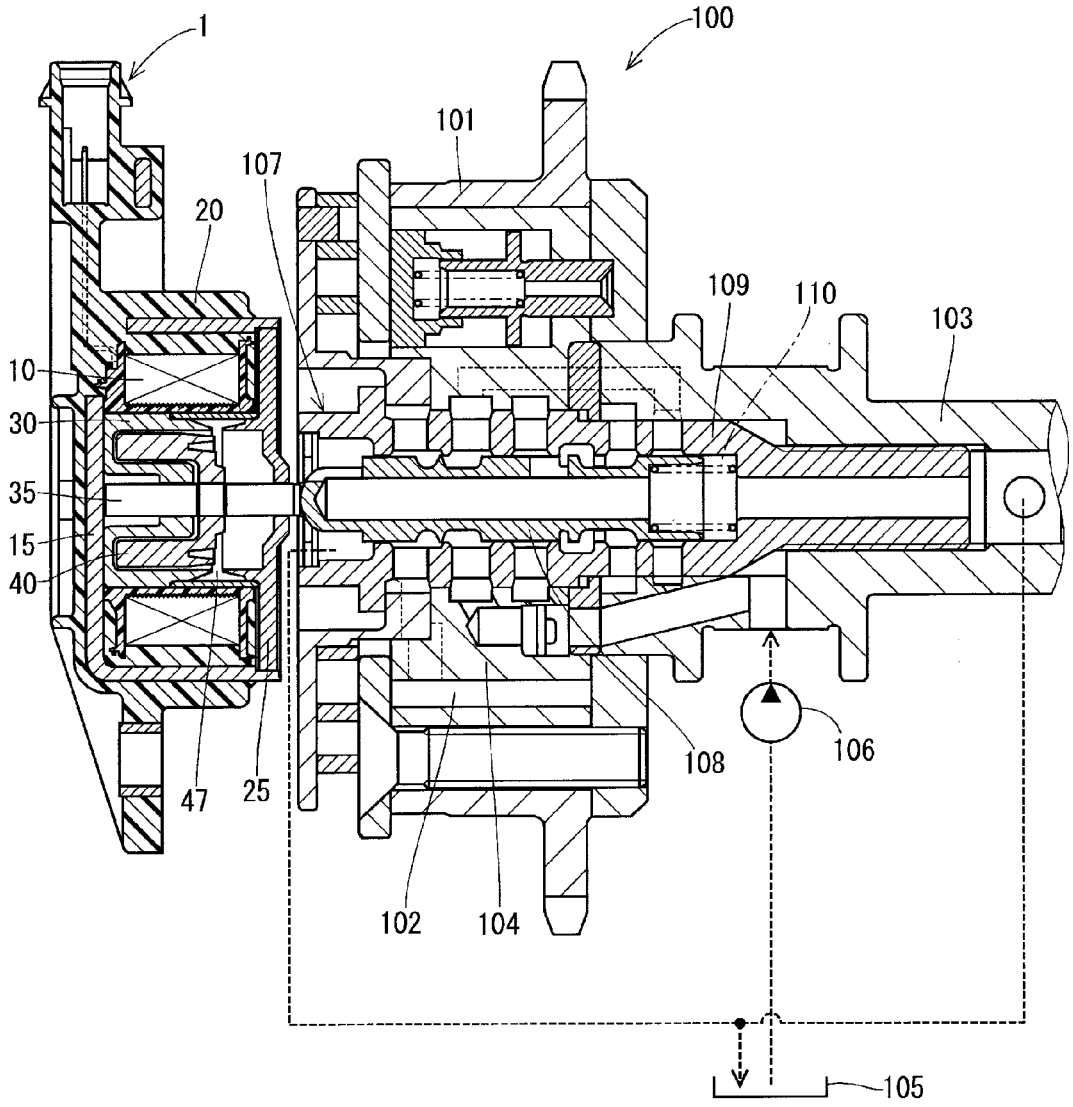
FIG. 1 is a schematic cross-sectional view of a valve timing control apparatus, in which a linear solenoid according to a first embodiment of the present disclosure is applied.

Various embodiments of the present disclosure will be described with reference to the accompanying drawings. In the following discussion of the embodiments, similar components will be indicated by the same reference numerals and will not be described redundantly for the sake of simplicity. Furthermore, any one or more components of any one or more of the following embodiments and modifications thereof may be combined with or replaced with any one or more components of another one or more of the following embodiments and modifications thereof within a principle of the present disclosure.

(First Embodiment)

FIG. 1 shows a valve timing control apparatus, which includes a linear solenoid according to a first embodiment of the present disclosure. In the valve timing control apparatus 100 of the present embodiment, hydraulic oil is supplied to a hydraulic pressure chamber 102 of a case 101 that is rotatable integrally with a crankshaft of an undepicted internal combustion engine, so that a vane rotor 104, which is rotatable integrally with a camshaft 103, is rotated relative to the case 101, and thereby opening/closing timing of each corresponding one of exhaust valves (not shown) is adjusted. The hydraulic oil, which is pumped from an oil pan 105 by an oil pump 106, is supplied to the hydraulic pressure chamber 102 through a hydraulic pressure change valve 107. A spool 108 of the hydraulic pressure change valve 107 is received in a sleeve 109 in a manner that enables reciprocation of the spool 108 in an axial direction. The spool 108 is axially urged toward one side (the left side in FIG. 1) by a spring 110. The linear solenoid 1 serves as a drive device, which axially drives the spool 108 toward the other side (the right side in FIG. 1) against the urging force of the spring 110.

Figure 2:
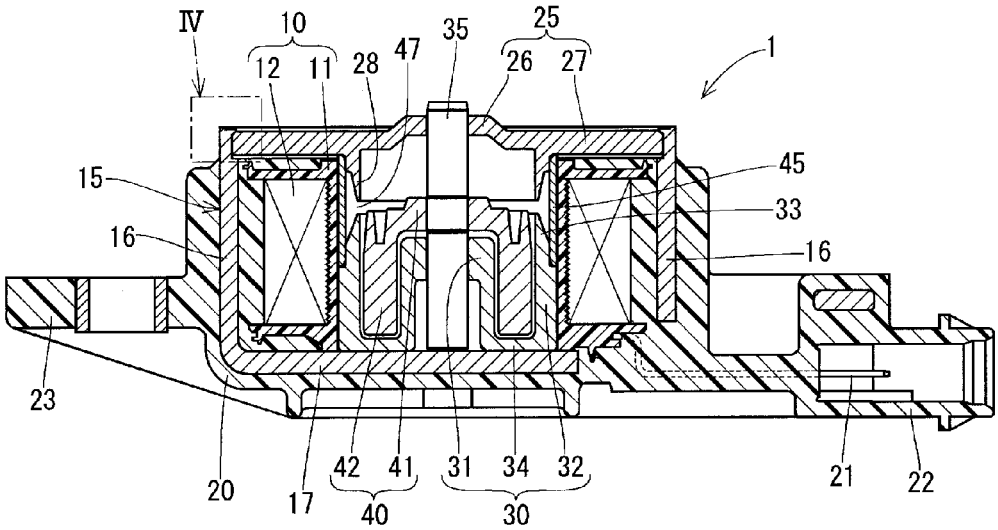
FIG. 2 is a cross-sectional view of the linear solenoid of the first embodiment, showing an operational state, in which a shaft is placed in an initial position.
Figure 3:
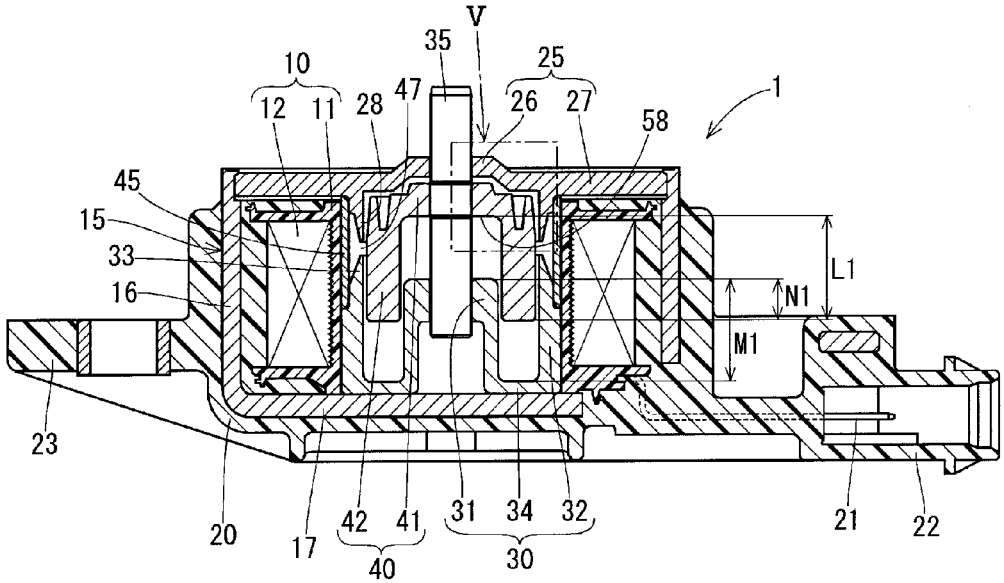
FIG. 3 is a cross-sectional view of the linear solenoid of the first embodiment, showing another operational state, in which the shaft is placed in a full stroke position.

Now, a structure of the linear solenoid 1 will be described with reference to FIGS. 2 and 3.

The linear solenoid 1 includes a coil arrangement 10, a yoke 15, a housing 20, a first stationary core 25, a second stationary core 30, a shaft 35 and a movable core 40.

The coil arrangement 10 includes a bobbin 11 and a coil 12. The bobbin 11 is formed into a tubular form. The coil 12 is formed into an annular form and is made of an electric wire, which is wound around the bobbin 11.

The yoke 15 is made of a magnetic material (a magnetic metal material) and includes a tubular portion 16 and a bottom portion 17. The tubular portion 16 is placed on an outer side of the coil arrangement 10 in the radial direction. The bottom portion 17 is formed integrally with one end part (the lower end part in FIG. 2) of the tubular portion 16.

The housing 20 is a resin member, which is molded integrally with the coil arrangement 10 and the yoke 15 (i.e., the coil arrangement 10 and the yoke 15 being insert molded in the housing 20). The housing 20 includes a connector portion 22 and installing portions 23. Terminals 21, which are electrically connected to the coil 12, are received in the connector portion 22. The installing portions 23 are used to install the housing 20 to, for example, an engine cover (not shown).

The first stationary core 25 is made of a magnetic material (a magnetic metal material) and is placed on one axial side of the coil 12, i.e., is placed at the other end part (the upper end part in FIG. 2) of the tubular portion 16, which is opposite from the one end part of the tubular portion 16 in the axial direction. The first stationary core 25 has a first annular projection 28, which projects toward the bottom portion 17 of the yoke 15 in the axial direction. A radially outer end portion (an outer peripheral portion) of the first stationary core 25 is fixed to the tubular portion 16 of the yoke 15.

The second stationary core 30 is made of a magnetic material (a magnetic metal material) and is placed on the other axial side of the coil 12, i.e., is placed at the one end part of the tubular portion 16. The second stationary core 30 contacts the bottom portion 17 of the yoke 15 in the axial direction and has a second annular projection 33. The second annular projection 33 projects toward the first annular projection 28 in the axial direction such that an air gap 47 is interposed between the second annular projection 33 and the first annular projection 28 in the axial direction. The first stationary core 25 and the second stationary core 30 are magnetically coupled to the yoke 15.

The shaft 35 is supported by the first stationary core 25 and the second stationary core 30 on a radially inner side of the air gap 47. The shaft 35 can axially reciprocate between an initial position, which is located on the second stationary core 30 side, and a full stroke position, which is located on the first stationary core 25 side. FIG. 2 shows one operational state where the shaft 35 is placed in the initial position, and FIG. 3 shows another operational state where the shaft 35 is placed in the full stroke position.

The movable core 40 is made of a magnetic material. The movable core 40 is placed between the first stationary core 25 and the second stationary core 30 in the axial direction and is fixed to the shaft 35. When the shaft 35 is placed in the initial position, the movable core 40 is placed on the second stationary core 30 side of the air gap 47. When the shaft 35 is placed in the full stroke position, the movable core 40 is placed radially inward of the air gap 47 such that the movable core 40 overlaps with both of the first annular projection 28 and the second annular projection 33 to magnetically bypass between the first annular projection 28 and the second annular projection 33, i.e., to conduct the magnetic flux between the first stationary core 25 and the second stationary core 30 through the movable core 40.

Next, a characteristic feature of the structure of the linear solenoid 1 will be described with reference to FIGS. 2 to 5.

The linear solenoid 1 includes a collar 45, which is formed into a tubular form and is placed between the first stationary core 25 and the second stationary core 30. The collar 45 is made of a non-magnetic material. One end portion of the collar 45 is press fitted to the first annular projection 28, and the other end portion of the collar 45 is press fitted to the second annular projection 33. The collar 45 limits or prohibits movement of the first stationary core 25 and the second stationary core 30 relative to each other in both of the axial direction and the radial direction.

The second stationary core 30 includes a bearing portion 31, a magnetic flux conducting portion (also referred to as an outer tubular portion) 32 and a connecting portion 34, which are formed integrally as a single integral member. The bearing portion 31 directly slidably supports the shaft 35. The magnetic flux conducting portion 32 is placed on an outer side of the bearing portion 31 in the radial direction, so that the magnetic flux conducting portion 32 is placed between the bearing portion 31 and the coil 12 in the radial direction. The connecting portion 34 connects between an end part of the magnetic flux conducting portion 32 and an end part of the bearing portion 31 on an axial side where the bottom portion 17 of the yoke 15 is located. The magnetic flux conducting portion 32 forms the second annular projection 33. The bearing portion 31 corresponds to a second bearing portion of the present disclosure. The second stationary core 30 axially contacts the bottom portion 17 of the yoke 15 to magnetically couple between the second stationary core 30 and the bottom portion 17 of the yoke 15 and thereby to conduct a magnetic flux therebetween.

Figure 4:
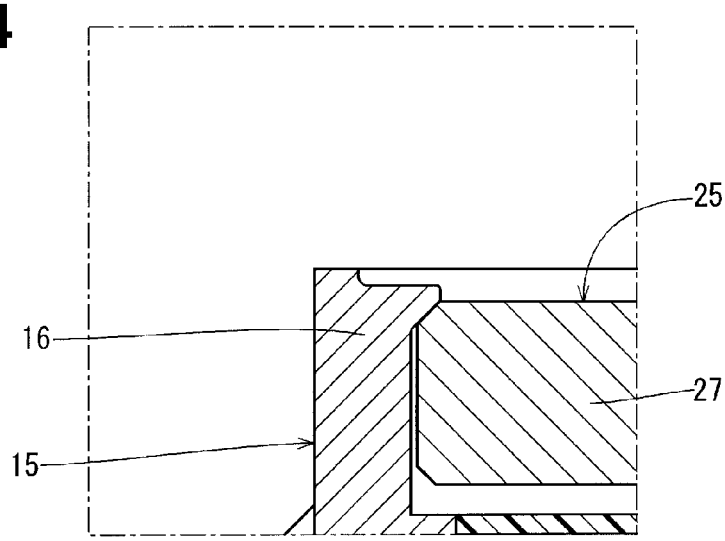
FIG. 4 is a partial enlarged view showing a portion of FIG. 2 indicated with a dot-dash line IV in FIG. 2.

The first stationary core 25 includes a bearing portion 26 and a fixing portion 27. The bearing portion 26 directly slidably supports the shaft 35. The fixing portion 27 outwardly extends from the bearing portion 26 in the radial direction and is formed into an annular plate form. The fixing portion 27 has the first annular projection 28. Furthermore, the fixing portion 27 is fitted into the other end part of the tubular portion 16 of the yoke 15. As shown in FIG. 4, the fixing portion 27 is fixed to the yoke 15 by swaging, i.e., by plastically deforming the end part of the tubular portion 16 against the fixing portion 27 in a state where the collar 45 and the second stationary core 30 are axially clamped between the bottom portion 17 of the yoke 15 and the fixing portion 27. The bearing portion 26 corresponds to a first bearing portion of the present disclosure. The first stationary core 25 is magnetically coupled with the tubular portion 16 of the yoke 15 to conduct the magnetic flux therebetween. The bearing portion 26 and the fixing portion 27 are integrally and seamlessly formed from the magnetic metal material to provide the first stationary core 25 as a seamless one-piece core.

The movable core 40 includes a holding portion 41 and a magnetic flux conducting portion 42. The holding portion 41 securely holds the shaft 35 at a corresponding location, which is located between the bearing portion 31 and the bearing portion 26 in the axial direction. The magnetic flux conducting portion 42 is formed into a tubular form and axially extends from the holding portion 41 toward the connecting portion 34 at a radial location, which is located between the bearing portion 31 and the magnetic flux conducting portion 32 in the radial direction. In the state where the shaft 35 is placed in the initial position, the magnetic flux conducting portion 42 forms a small axial gap between the magnetic flux conducting portion 42 and the connecting portion 34. In other words, the magnetic flux conducting portion 42 extends toward the connecting portion 34 as much as possible without causing contact of the magnetic flux conducting portion 42 to the connecting portion 34 of the second stationary core 30 at the time of moving the shaft 35 between the initial position and the full stroke position.

Figure 5:
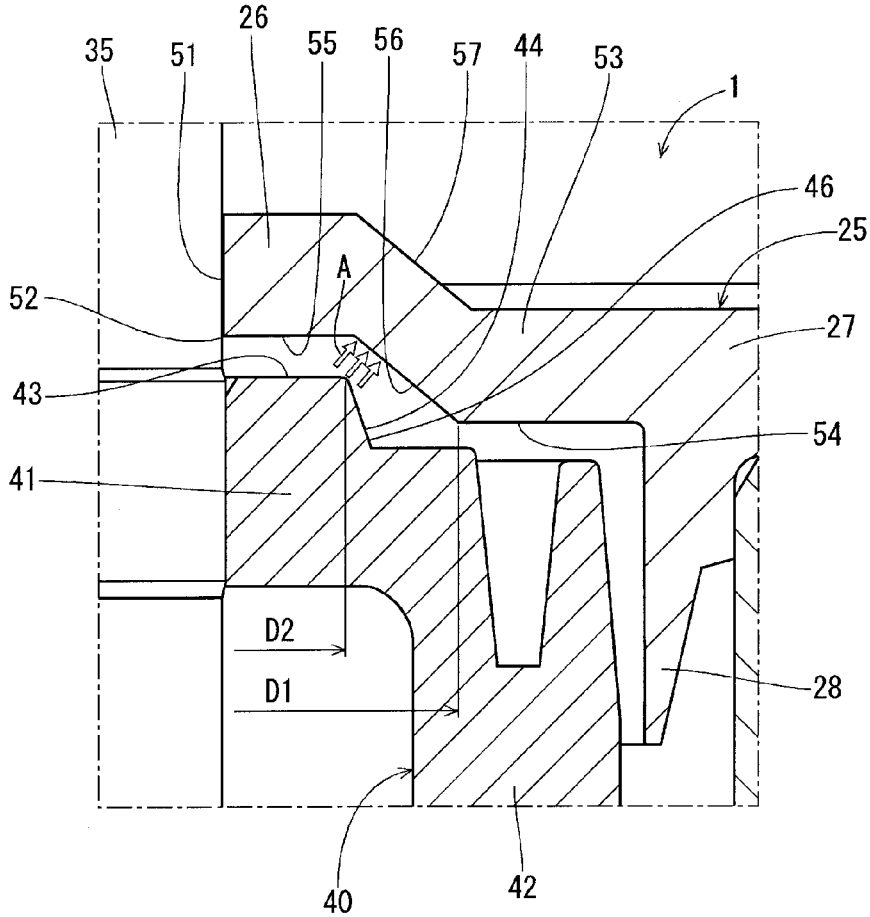
FIG. 5 is a partial enlarged view showing an area V in FIG. 3.

With reference to FIG. 5, the bearing portion 26 of the first stationary core 25 has a through-hole 51, which slidably receives the shaft 35. The bearing portion 26 also has a radially outer part 53, which is located on a radially outer side of the through-hole 51. The radially outer part 53 has an axial end surface 54, which is placed on an axial side where the movable core 40 is located. One axial end of the through-hole 51, which is located on the movable core 40 side, has a peripheral edge 52 that is placed at a corresponding axial position. Specifically, the corresponding axial position of the peripheral edge 52 is on an axial side of the axial end surface 54 of the radially outer part 53, which is opposite from the movable core 40 in the axial direction. Specifically, the bearing portion 26 of the first stationary core 25 has a recess 55, which is located on the movable core 40 side and is axially recessed away from the movable core 40. A diameter (an outer diameter) D1 of an outer peripheral edge of the recess 55 is larger than an outer diameter D2 of an axial end 43 of the holding portion 41 of the movable core 40, which is located on the axial side where the bearing portion 26 is located. Thereby, a part of the holding portion 41 of the movable core 40 can be received in the recess 55 when the movable core 40 is moved toward the bearing portion 26 of the first stationary core 25 in the axial direction.

A radially inner surface (an inner peripheral surface) 56 of the recess 55 of the first stationary core 25 is tapered to have a progressively increasing inner diameter, which progressively increases in the axial direction toward the movable core 40. The holding portion 41 of the movable core 40 is stepped such that an end part 46 is formed at the bearing portion 26 side of the holding portion 41 and has a reduced outer diameter that is reduced in comparison to an outer diameter of an axially adjacent part of the holding portion 41, which is located on an opposite axial side of the end part 46 of the holding portion 41 that is opposite from the bearing portion 26 in the axial direction. A first radially outer surface (a first radially outer surface) 44 of the end part 46 of the holding portion 41 is tapered to have a progressively decreasing outer diameter, which progressively decreases in the axial direction toward the first stationary core 25. The first radially outer surface 44 is radially opposed to the radially inner surface 56 of the recess 55 of the first stationary core 25. The bearing portion 26 of the first stationary core 25 axially projects relative to the fixing portion 27 toward the side, which is opposite from the movable core 40. A second radially outer surface (a second outer peripheral surface) 57 of this projecting part of the bearing portion 26 is tapered to have a progressively increasing outer diameter, which progressively increases in the axial direction toward the movable core 40.

Next, operation of the linear solenoid 1 will be described with reference to FIGS. 1 to 3, 5 and 6.

The coil 12 is deenergized when the hydraulic oil is not supplied to the hydraulic pressure chamber 102 of the valve timing control apparatus 100. At this time, the shaft 35 is urged against the bottom portion 17 of the yoke 15 by the spring 110 of the hydraulic pressure change valve 107, so that the shaft 35 is placed in the initial position.

The coil 12 is energized when the hydraulic oil is supplied to the hydraulic pressure chamber 102 of the valve timing control apparatus 100. The magnetic flux, which is generated around the coil 12 upon the energization of the coil 12, flows through a magnetic circuit that is formed by the first stationary core 25, the yoke 15, the second stationary core 30 and the movable core 40. The magnetic flux is conducted between the first stationary core 25 and the yoke 15 in the radial direction, and the magnetic flux is conducted between the yoke 15 and the second stationary core 30 in the axial direction. At this time, the movable core 40 is driven by a magnetic attractive force (a total magnetic attractive force), which is generated in response to the amount of magnetic flux that flows through the magnetic circuit, to drive the shaft 35 together with the movable core 40 toward the full stroke position against the urging force of the spring 110.

Figure 6:
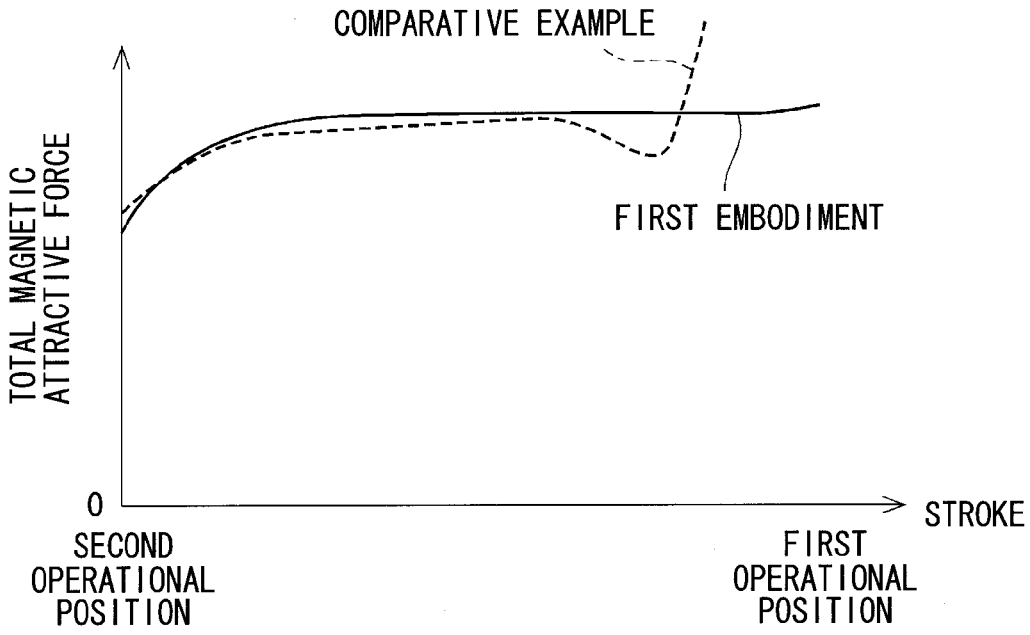
FIG. 6 is a diagram showing a relationship between the amount of stroke of a movable core and a total magnetic attractive force exerted to the movable core for the linear solenoid of the first embodiment and a linear solenoid of a comparative example.
Figure 33:
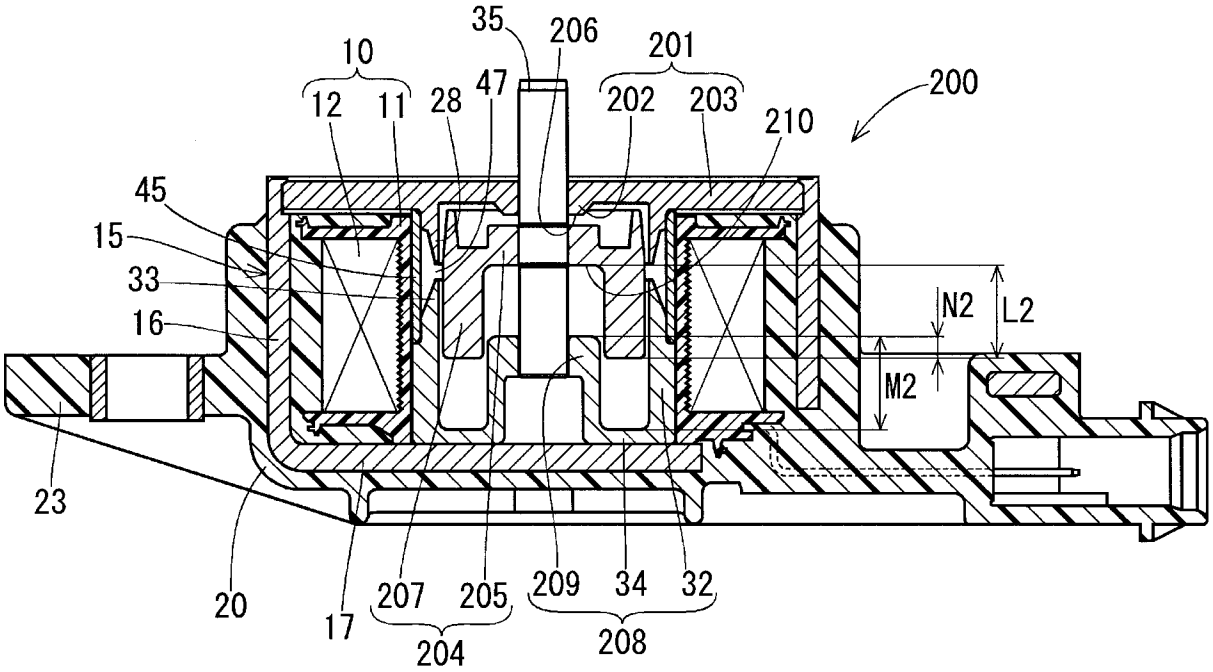
FIG. 33 RELATED ART
FIG. 33 is a cross-sectional view of a linear solenoid of a comparative example.

Here, a depth of a hole 58 of the movable core 40, which can receive the bearing portion 31 of the second stationary core 30, is indicated by L1. An axial length of the bearing portion 31 of the second stationary core 30 is indicated by M1. An axial extent of an overlapped area between the magnetic flux conducting portion 42 of the movable core 40 and the bearing portion 31 of the second stationary core 30 in the full stroke position of the shaft 35 is indicated by N1. In this overlapped area, an axial extent of the magnetic flux conducting portion 42 and an axial extent of the bearing portion 31 are overlapped with each other, and an axial extent of this overlapped area is referred to as the axial extent of the overlapped area. FIG. 33 shows a linear solenoid 200 of a comparative example, in which a bearing portion 202 of a first stationary core 201 axially projects relative to a fixing portion 203 of the first stationary core 201. A depth of a hole 210 of a movable core 204, which can receive a bearing portion 209 of a second stationary core 208, is indicated by L2. Furthermore, an axial length of the bearing portion 209 of the second stationary core 208 is indicated by M2. Also, an axial extent of an overlapped area between a magnetic flux conducting portion 207 of the movable core 204 and the bearing portion 209 of the second stationary core 208 in the full stroke position of the shaft 35 is indicated by N2. In such a case, the depth L1 of the first embodiment is larger than the depth L2 of the comparative example, and the axial length M1 of the first embodiment is larger than the axial length M2 of the comparative example. Thereby, the axial extent N1 of the overlapped area of the first embodiment becomes larger than the axial extent N2 of the overlapped area of the comparative example. Therefore, an increase in a density of the magnetic flux, which is conducted between the movable core 40 and the second stationary core 30, is limited, and thereby it is possible to limit a rapid increase in the magnetic attractive force, which axially attracts the movable core 40 toward the second stationary core 30. FIG. 6 indicates a relationship between the amount of stroke of the movable core 40 from the initial position to the full stroke position and the corresponding total magnetic attractive force. As shown in FIG. 6, the total magnetic attractive force is reduced in the latter half of the stroke at the time of moving the movable core toward the full stroke position in the case of the comparative example, as indicated by a dotted line. In contrast, in the case of the first embodiment, the total magnetic attractive force is not reduced in the latter half of the stroke at the time of moving the movable core toward the full stroke position, as indicated by a solid line in FIG. 6.

Furthermore, in the comparative case of FIG. 33 where an axial end surface 206 of the bearing portion 202, which is opposed to the holding portion 205 of the movable core 204 in the axial direction, is a planar surface. In such a case, when the gap between the movable core 204 and the first stationary core 201 becomes small, the magnetic attractive force, which attracts the movable core 204 toward the first stationary core 201, is rapidly increased. Thereby, at that time, as indicated by the dotted line in FIG. 6, the total magnetic attractive force is rapidly increased. In contrast, in the case of the first embodiment, the bearing portion 26 of the first stationary core 25 is axially recessed toward the side, which is opposite from the movable core 40 in the axial direction. Therefore, the gap between the movable core 40 and the first stationary core 25 can be increased by the amount, which corresponds to the amount of the axial recess of the bearing portion 26. As a result, it is possible to avoid the formation of the range (area), in which the total magnetic attractive force is rapidly increased.

Furthermore, in the first embodiment, the radially inner surface 56 of the bearing portion 26 of the first stationary core 25 and the first radially outer surface 44 of the holding portion 41 of the movable core 40 are both tapered. Therefore, as indicated by arrows A in FIG. 5, a direction of the magnetic attractive force does not coincide with the axial direction of the shaft 35 and is angled relative to the axial direction. Thus, it is possible to adjust an axial component of the magnetic attractive force by the tapering of the radially inner surface 56 and the tapering of the first radially outer surface 44. Thereby, as indicated by the solid line in FIG. 6, the total magnetic attractive force can be adjusted to be generally flat in the latter half of the stroke of the movable core 40, i.e., the substantial change in the total magnetic attractive force can be eliminated in the latter half of the stroke of the movable core 40. The tapering of the radially inner surface 56, the tapering of the second radially outer surface 57 and the tapering of the first radially outer surface 44 are set such that the substantial change in the total magnetic attractive force is eliminated in the latter half of the stroke of the movable core 40 to have the generally flat total magnetic attractive force in the latter half of the stroke of the movable core 40.

As discussed above, in the linear solenoid 1 of the first embodiment, the first stationary core 25 is formed such that the peripheral edge 52 of the axial end of the through-hole 51, which is located on the movable core 40 side, is placed on the axial side of the axial end surface 54 of the radially outer part 53 of the bearing portion 26, which is opposite from the movable core 40 in the axial direction. Specifically, the bearing portion 26 of the first stationary core 25 has the recess 55, which can receive the end part 46 of the holding portion 41 of the movable core 40. The depth L1 of the hole 58 of the movable core 40 of the first embodiment is larger than the depth L2 of the hole 210 of the movable core 204 of the comparative example. Furthermore, the axial length M1 of the bearing portion 31 of the second stationary core 30 of the first embodiment is larger than the axial length M2 of the bearing portion 209 of the second stationary core 208 of the comparative example.

Thereby, the axial extent of the overlapped area between the magnetic flux conducting portion 42 of the movable core 40 and the bearing portion 31 of the second stationary core 30 in the latter half of the stroke in the first embodiment becomes larger than the axial extent of the overlapped area between the magnetic flux conducting portion 207 of the movable core 204 and the bearing portion 209 of the second stationary core 208 in the latter half of the stroke in the comparative example. Thus, the increase in the density of the magnetic flux, which is conducted between the movable core 40 and the second stationary core 30, is limited. As a result, it is possible to limit the rapid increase in the magnetic attractive force, which axially attracts the movable core 40 toward the second stationary core 30. Thereby, the substantial change in the total magnetic attractive force caused by the change in the amount of stroke of the movable core 40 can be effectively limited without increasing the size of the linear solenoid 1.

Furthermore, in the first embodiment, the radially inner surface 56 of the recess 55 of the first stationary core 25 is tapered to have the progressively increasing inner diameter, which progressively increases in the axial direction toward the movable core 40. Furthermore, the first radially outer surface 44 of the holding portion 41 of the movable core 40 is tapered to have the progressively decreasing outer diameter, which progressively decreases in the axial direction toward the first stationary core 25, and the first radially outer surface 44 is radially opposed to the radially inner surface 56 of the recess 55 of the first stationary core 25.

Therefore, it is possible to adjust the axial component of the magnetic attractive force by the tapering of the radially inner surface 56 and the tapering of the first radially outer surface 44. Thereby, the total magnetic attractive force can be adjusted to be generally flat in the latter half of the stroke of the movable core 40, i.e., the substantial change in the total magnetic attractive force can be eliminated in the latter half of the stroke of the movable core 40.

Furthermore, in the first embodiment, the second radially outer surface 57 of the projecting part of the bearing portion 26 of the first stationary core 25 is tapered to have the progressively increasing outer diameter, which progressively increases in the axial direction toward the movable core 40.

Therefore, the density of the magnetic flux, which flows through the first stationary core 25, can be adjusted by the second radially outer surface 57, and thereby it is possible to limit the change in the total magnetic attractive force caused by the change in the amount of stroke of the movable core 40.

Furthermore, in the first embodiment, the bearing portion 26 of the first stationary core 25 projects in the axial direction relative to the fixing portion 27 on the axial side, which is opposite from the movable core 40 in the axial direction.

Thereby, intrusion of foreign objects such, as iron debris, into the through-hole 51 of the bearing portion 26 can be limited by the projecting part of the bearing portion 26. Also, the axial length of the bearing portion 26 is increased, so that the slidability and the wear resistance of the shaft 35, which is slidably received in the through-hole 51, can be improved.

(Second Embodiment)

Figure 7:
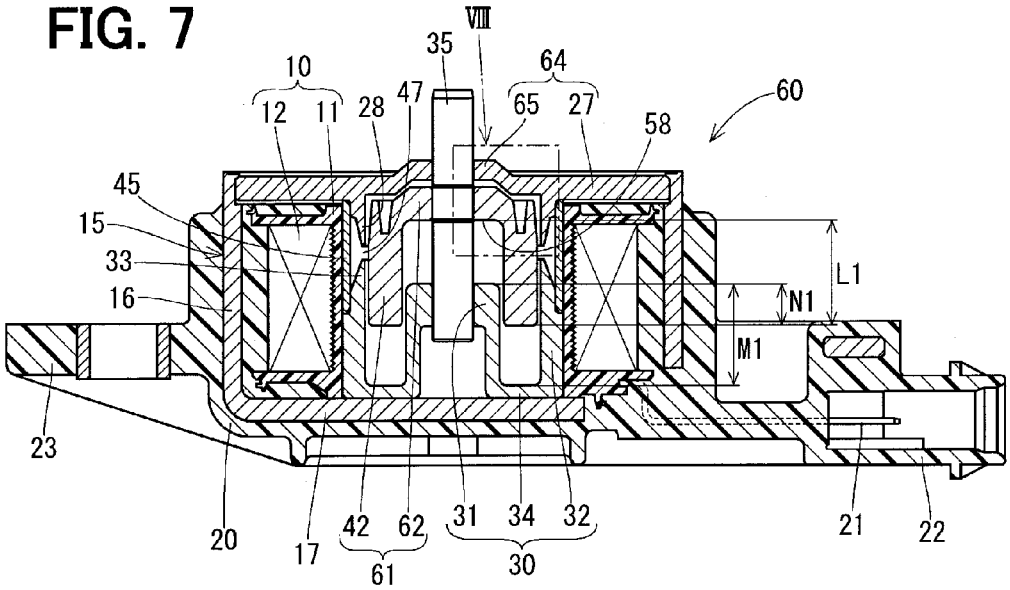
FIG. 7 is a cross-sectional view of a linear solenoid according to a second embodiment of the present disclosure.
Figure 8:
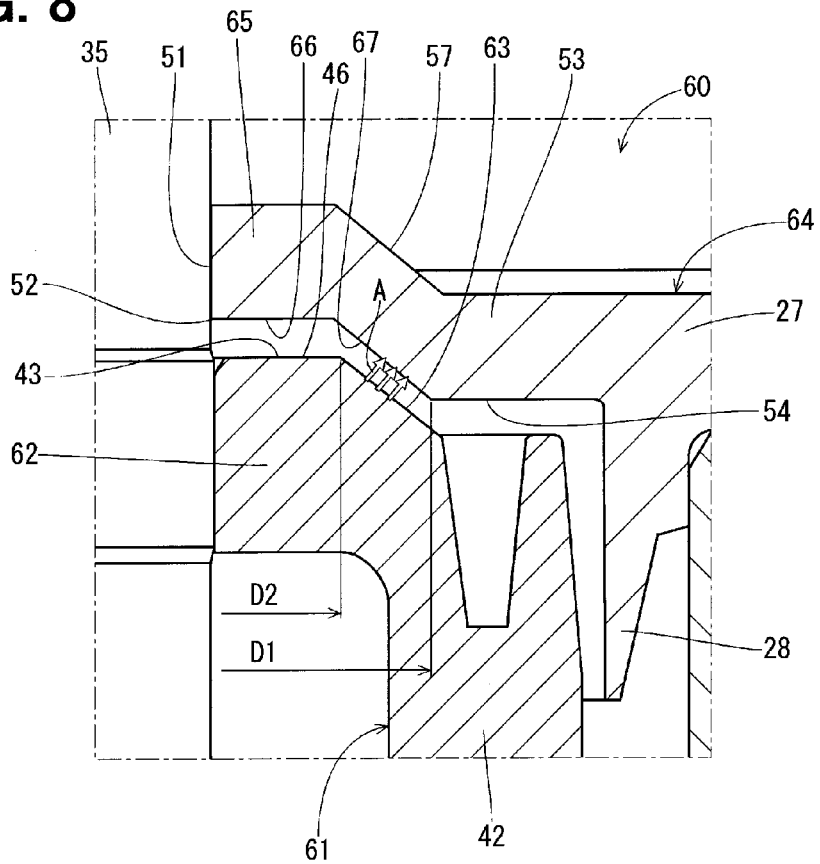
FIG. 8 is a partial enlarged view of an area VIII in FIG. 7.

A linear solenoid according to a second embodiment of the present disclosure will be described with reference to FIGS. 7 and 8. The second embodiment is a modification of the first embodiment. In the following discussion, differences of the second embodiment, which are different from the first embodiment, will be mainly discussed.

In the linear solenoid 60, a holding portion 62 of a movable core 61 has a first radially outer surface (a first outer peripheral surface) 63, which is tapered and has a surface area that is larger than the surface area of the first radially outer surface 44 of the holding portion 41 of the first embodiment. Furthermore, a recess 66 of a bearing portion 65 of a first stationary core 64 has a radially inner surface (an inner peripheral surface) 67, which is tapered and is radially opposed to the first radially outer surface 63.

According to the second embodiment, the advantages, which are similar to those of the first embodiment, can be achieved. Particularly, the tapering of the first radially outer surface 63 and the tapering of the radially inner surface 67 can be advantageously set to adjust the magnetic attractive force between the movable core 61 and the first stationary core 64 to limit the change in the total magnetic attractive force caused by the change in the amount of stroke of the movable core 61.

(Third Embodiment)

Figure 9:
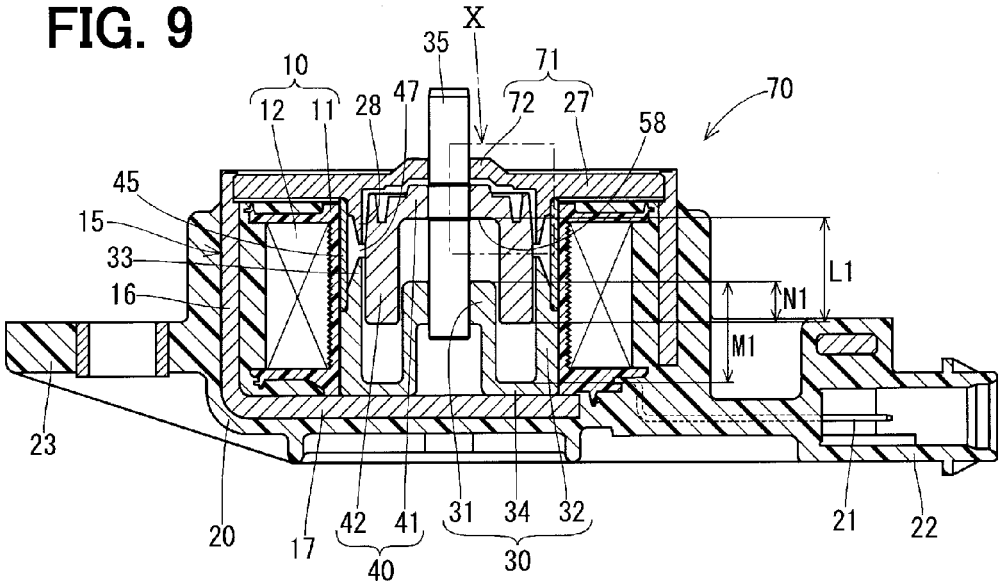
FIG. 9 is a cross-sectional view of a linear solenoid according to a third embodiment of the present disclosure.
Figure 10:
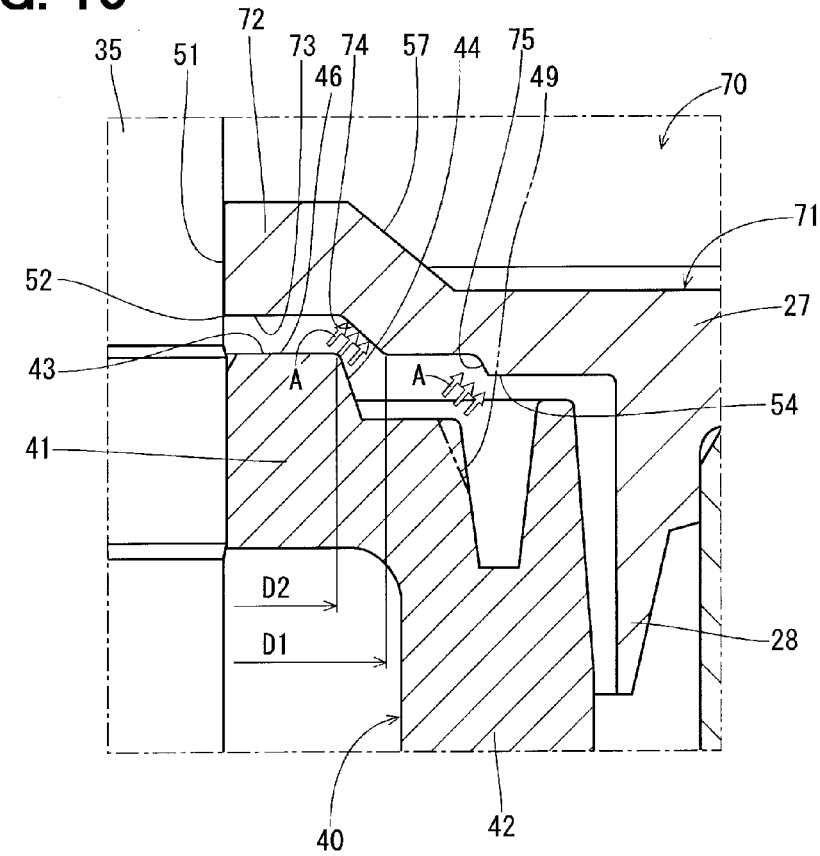
FIG. 10 is a partial enlarged view showing an area X in FIG. 9.

A linear solenoid according to a third embodiment of the present disclosure will be described with reference to FIGS. 9 and 10. The third embodiment is a modification of the first embodiment. In the following discussion, differences of the third embodiment, which are different from the first embodiment, will be mainly discussed.

In the linear solenoid 70, a recess 73 of a bearing portion 72 of a first stationary core 71 has two tapered radially inner surfaces 74, 75, which are radially spaced from each other and are radially opposed to the movable core 40. Specifically, the first stationary core 71 is stepped to have the two tapered surfaces 74, 75 at a location that is opposed to the movable core 40. The tapered surfaces 74, 75 are radially spaced from each other by an annular flat surface, which is generally flat in a direction that is generally perpendicular to the axial direction of the shaft 35.

According to the third embodiment, the advantages, which are similar to those of the first embodiment, can be achieved. Particularly, the tapering of the radially inner surface 74 and the tapering of the radially inner surface 75 can be advantageously set to adjust the magnetic attractive force between the movable core 40 and the first stationary core 71 to limit the change in the total magnetic attractive force caused by the change in the amount of stroke of the movable core 40. Furthermore, another first radially outer surface (indicated by a dot-dot-dash line 49 in FIG. 10), which is other than the first radially outer surface 44 and is tapered in a manner similar to the first radially outer surface 44, may be formed in the end part 46 of the holding portion 41 of the movable core 40 to radially opposite the tapered surface 75, if desired. In such a case, a radial distance from the tapered surface 75 to this first radially outer surface (indicated by the dot-dot-dash line 49 in FIG. 10) may be made shorter.

(Fourth Embodiment)

Figure 11:
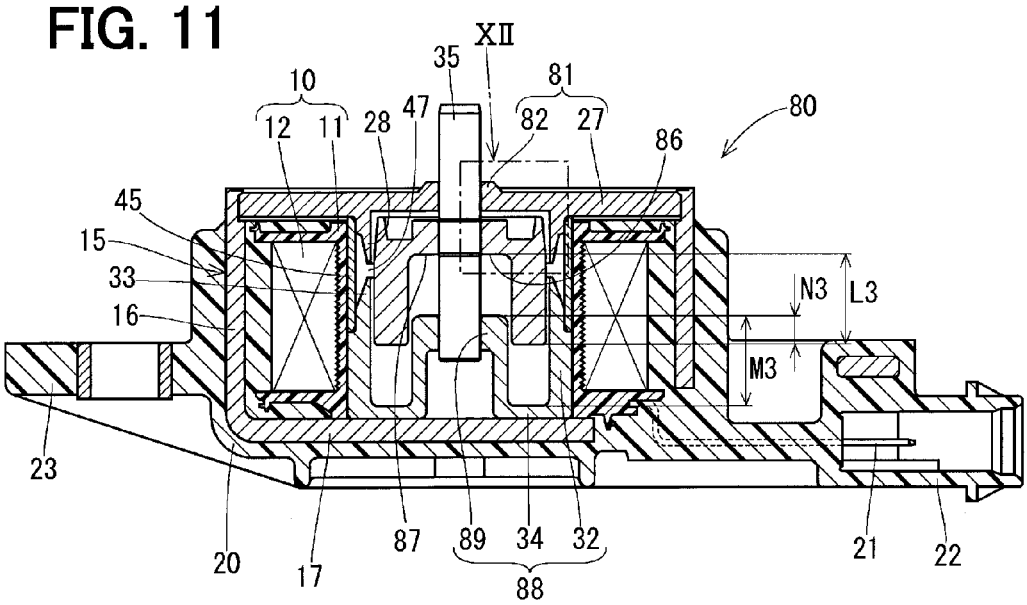
FIG. 11 is a cross-sectional view of a linear solenoid according to a fourth embodiment of the present disclosure.
Figure 12:
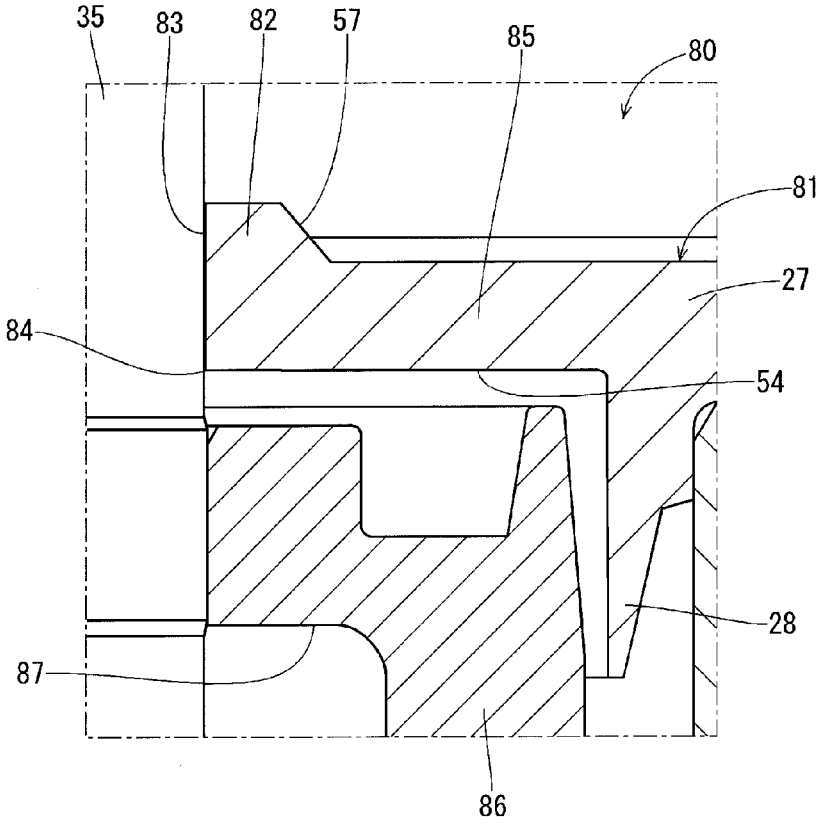
FIG. 12 is a partial enlarged view of an area XII in FIG. 11.
Figure 13:
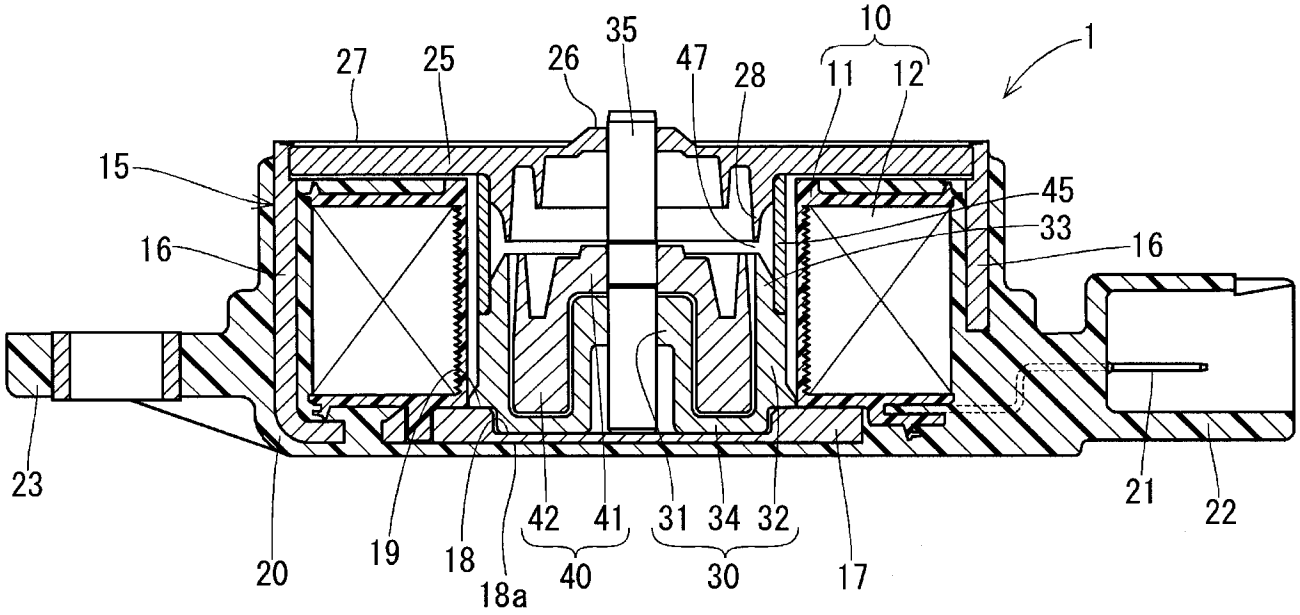
FIG. 13 is a cross-sectional view of a linear solenoid according to a fifth embodiment of the present disclosure, showing an operational state, in which a shaft is placed in an initial position.
Figure 14:
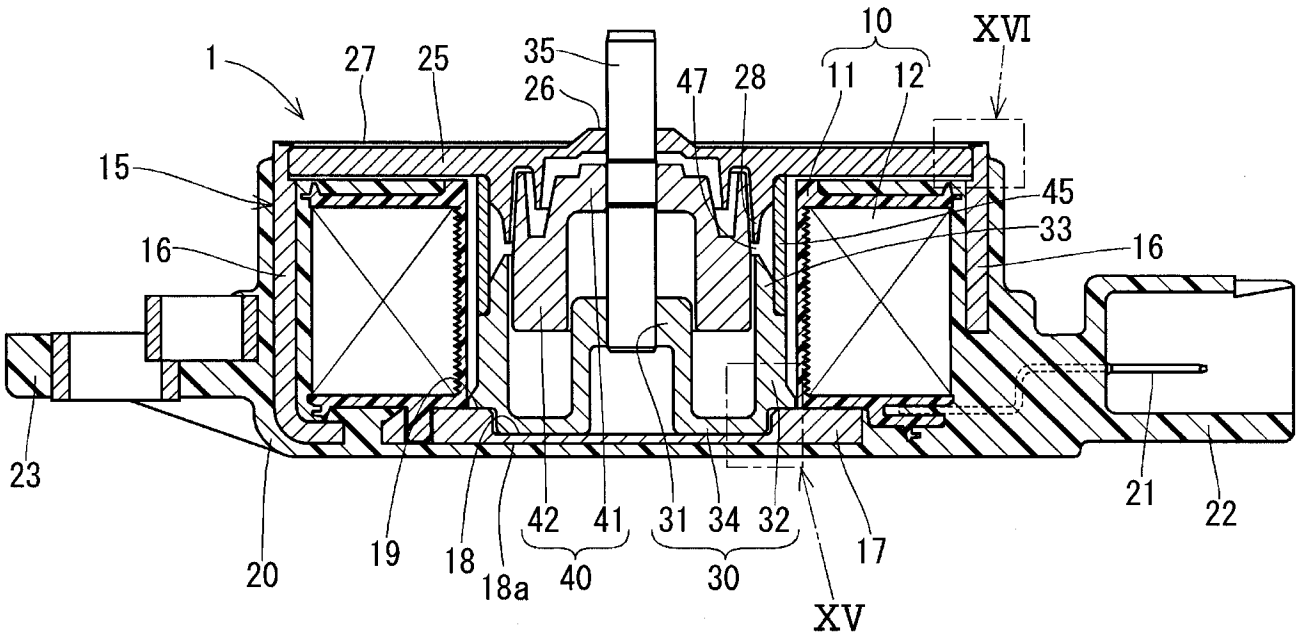
FIG. 14 is a cross-sectional view of the linear solenoid of the fifth embodiment, showing another operational state, in which the shaft is placed in a full stroke position.

A linear solenoid according to a fourth embodiment of the present disclosure will be described with reference to FIGS. 11 and 12. The fourth embodiment is a modification of the first embodiment. In the following discussion, differences of the fourth embodiment, which are different from the first embodiment, will be mainly discussed.

In the linear solenoid 80, an axial position of a peripheral edge 84 of an axial end of a through-hole 83 of a bearing portion 82, which is located on a movable core 86 side, is the same as the axial position of the axial end surface 54 of the radially outer part 85 of the bearing portion 82. A depth L3 of the hole 87 of the movable core 86 of the fourth embodiment is larger than the depth L2 of the hole 210 of the movable core 204 of the comparative example. Furthermore, an axial length M3 of a bearing portion 89 of a second stationary core 88 of the fourth embodiment is larger than the axial length M2 of the bearing portion 209 of the second stationary core 208 of the comparative example shown in FIG. 33.

Even in the case of the fourth embodiment, in which the bearing portion 82 of the first stationary core 81 does not have the recess, it is possible to limit the change in the total magnetic attractive force caused by the change in the amount of stroke of the movable core 86.

Furthermore, in the fourth embodiment, the axial length of the bearing portion 82 is lengthened, so that the slidability of the shaft 35 relative to the bearing portion 82 is effectively improved.

(Fifth Embodiment)

A fifth embodiment of the present disclosure will be described with reference to FIGS. 13 to 20. The fifth embodiment is a modification of the first embodiment. In the following discussion, differences of the fifth embodiment, which are different from the first embodiment, will be mainly discussed.

In the second stationary core 30, the connecting portion 34 connects between a radially inner section 36 of an end part of the magnetic flux conducting portion 32 and the bearing portion 31 on an axial side where the bottom portion 17 of the yoke 15 is located. The magnetic flux conducting portion 32 has a radially outer section 37 in an end part of the magnetic flux conducting portion 32, which is located on the bottom portion 17 side in the axial direction and forms a flange that radially outwardly projects. The magnetic flux conducting portion 32 also has the second annular projection 33, which projects toward the first annular projection 28 such that the air gap 47 is interposed between the second annular projection 33 and the first annular projection 28 in the axial direction.

The bottom portion 17 of the yoke 15 has a recess (also referred to as a hole) 18, into which a part of the connecting portion 34 of the second stationary core 30 is inserted, i.e., is received. The recess 18 is formed as a hole, which has a bottom 18*a*, i.e., a bottom wall. In other words, the recess (hole) 18 is axially recessed from an inner surface (upper surface in FIG. 15) 116 of the wall of the bottom portion 17 in a direction away from the first stationary core 25 to form the bottom 18*a*. Furthermore, the collar 45 and the magnetic flux conducting portion 32 of the second stationary core 30 are clamped between the bottom portion 17 of the yoke 15 and the first stationary core 25 in the axial direction. The radially outer section 37 of the magnetic flux conducting portion 32 of the second stationary core 30 contacts a peripheral edge part 119 of the recess 18 of the bottom portion 17 of the yoke 15 in the axial direction. The bottom portion 17 of the yoke 15 can conduct the magnetic flux to the magnetic flux conducting portion 32 of the second stationary core 30 in the axial direction.

Figure 15:
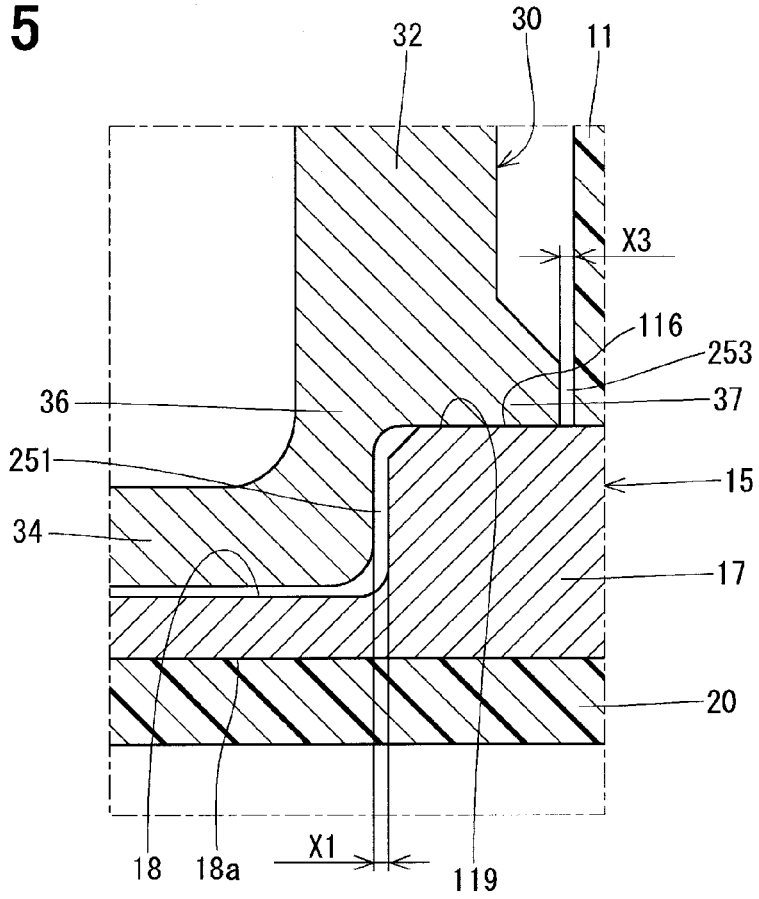
FIG. 15 is a partial enlarged view of an area XV shown in FIG. 14.
Figure 16:
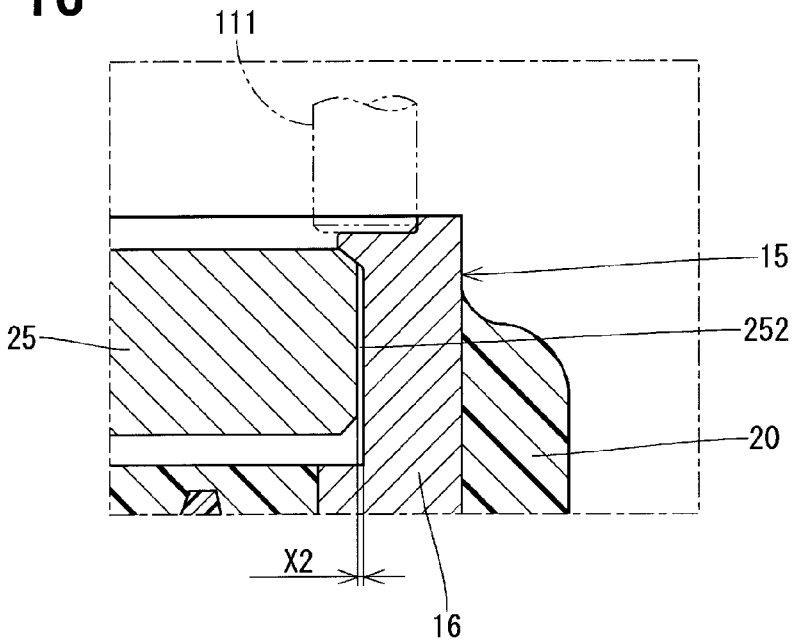
FIG. 16 is a partial enlarged view showing an area XVI in FIG. 14.

The first stationary core 25 is formed into an annular plate form and is fitted to the other end part of the tubular portion 16 of the yoke 15. The first stationary core 25 is fixed to the yoke 15 by swaging, i.e., by plastically deforming the other end part of the tubular portion 16 against the first stationary core 25 in a state where the collar 45 and the second stationary core 30 are axially clamped between the bottom portion 17 of the yoke 15 and the first stationary core 25. The first stationary core 25 is magnetically coupled with the tubular portion 16 of the yoke 15 to conduct the magnetic flux therebetween in the radial direction. A first gap 251 is formed between an inner surface of the recess 18 of the yoke 15 and the connecting portion 34 of the second stationary core 30 in the radial direction, as shown in FIG. 15. Furthermore, a second gap 252 is formed between the tubular portion 16 of the yoke 15 and the first stationary core 25 in the radial direction, as shown in FIG. 16. A minimum radial size X1 of the first gap 251 is larger than a maximum radial size X2 of the second gap 252. Furthermore, the second stationary core 30 and the collar 45 are radially spaced from the bobbin 11 by a third gap 253, as shown in FIG. 15. A minimum radial size X3 of the third gap 253 shown in FIG. 15 is larger than the maximum radial size X2 of the second gap 252 shown in FIG. 16.

The movable core 40 includes the holding portion 41 and the magnetic flux conducting portion 42. The holding portion 41 securely holds the shaft 35. The magnetic flux conducting portion 42 is formed into a tubular form and axially extends from the holding portion 41 toward the bottom portion 17 of the yoke 15. The magnetic flux conducting portion 42 is placed between the bearing portion 31 and the magnetic flux conducting portion 32 of the second stationary core 30. Furthermore, in the state where the shaft 35 is placed in the initial position of FIG. 13, the magnetic flux conducting portion 42 forms the small axial gap between the magnetic flux conducting portion 42 and the connecting portion 34 of the second stationary core 30. In other words, the magnetic flux conducting portion 42 extends toward the connecting portion 34 as much as possible without causing contact of the magnetic flux conducting portion 42 to the connecting portion 34 of the second stationary core 30 at the time of moving the shaft 35 between the initial position of FIG. 13 and the full stroke position of FIG. 14.

Figure 17:
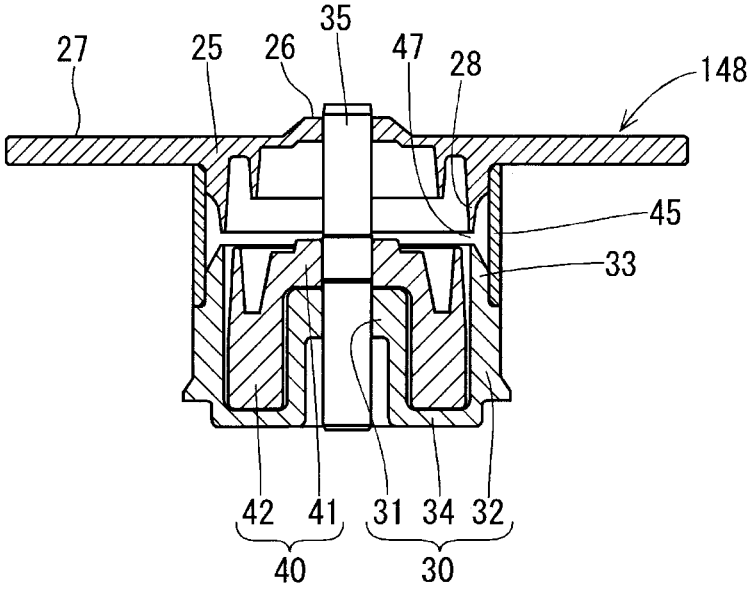
FIG. 17 is a cross-sectional view of a subassembly, in which a first stationary core, a second stationary core, a shaft and a movable core of FIG. 13 are integrally assembled.

At the time of assembling the linear solenoid 1, the collar 45 is press fitted to the first annular projection 28 and the second annular projection 33. Thereby, as shown in FIG. 17, the first stationary core 25, the second stationary core 30, the shaft 35 and the movable core 40 are assembled together to form a subassembly 148.

Figure 18:
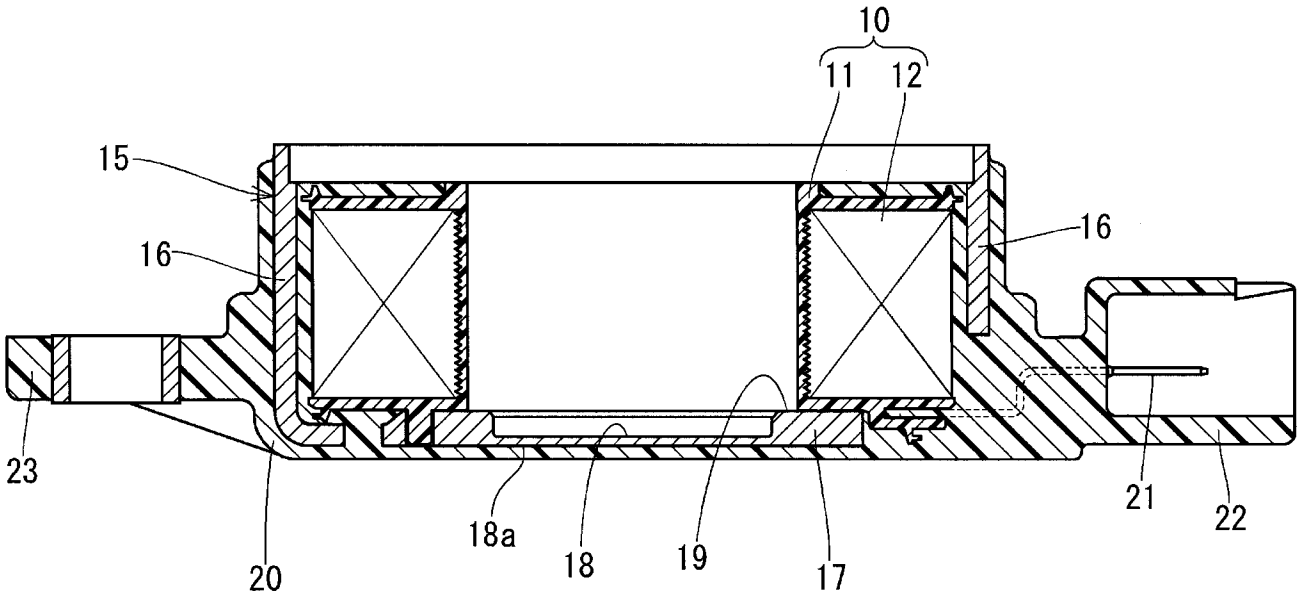
FIG. 18 is a cross-sectional view showing a yoke, a coil arrangement and a housing of FIG. 13.
Figure 19:
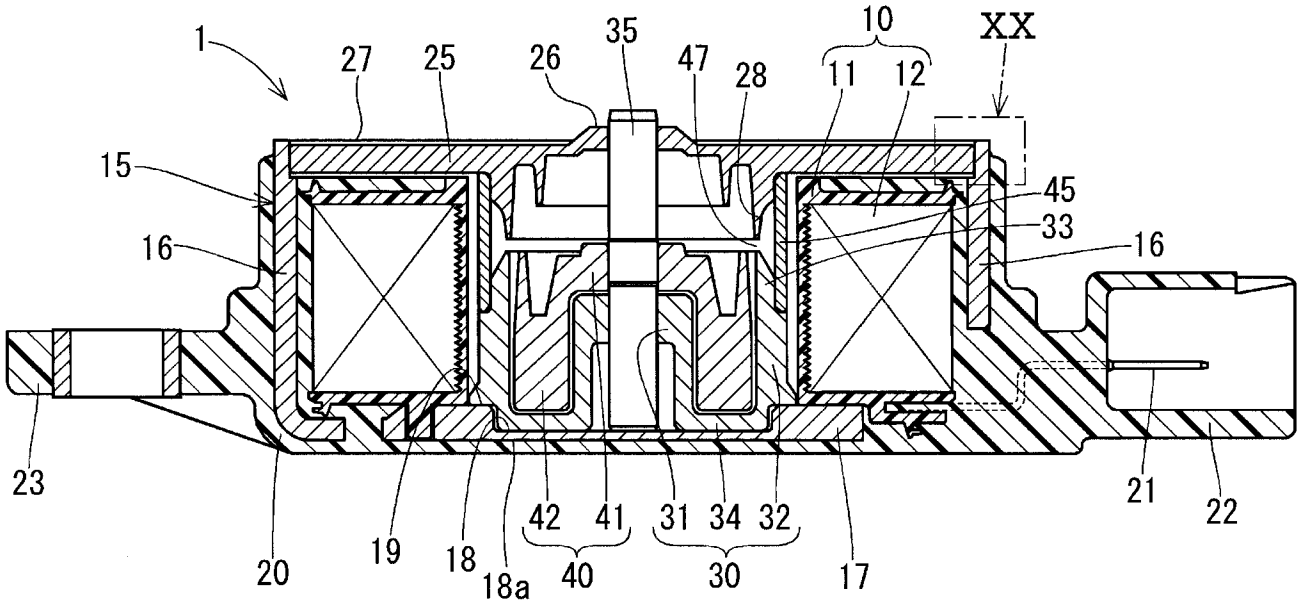
FIG. 19 is a schematic cross sectional view, showing a state where the subassembly of FIG. 17 is installed to the coil arrangement and the yoke of FIG. 18.
Figure 20:
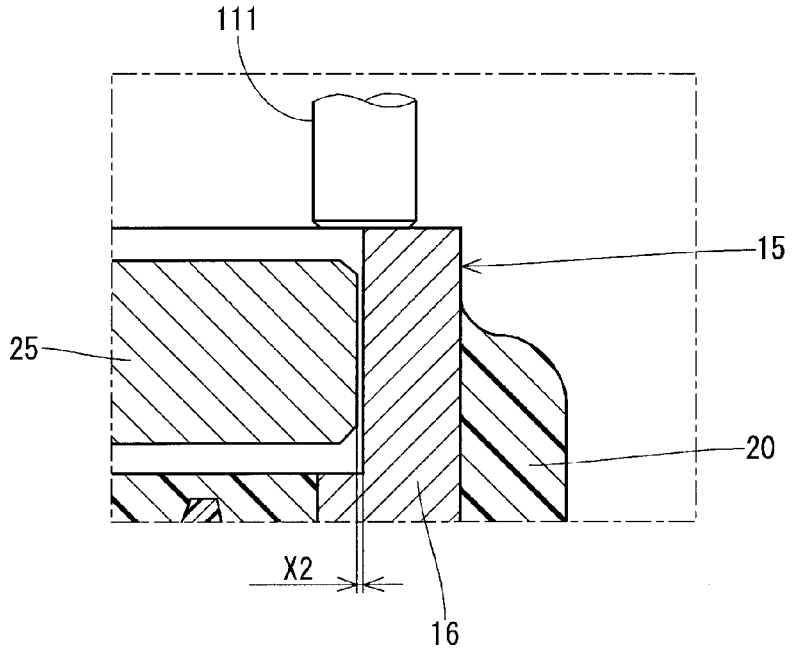
FIG. 20 is a partial enlarged cross-sectional view of an area XX in FIG. 19.

The subassembly 148 is installed to the yoke 15 and the coil arrangement 10, which are resin molded together, as shown in FIG. 18, until the magnetic flux conducting portion 32 of the second stationary core 30 contacts the peripheral edge part 119 of the recess 18 of the yoke 15 in the axial direction, as shown in FIG. 19. At this stage of the assembling operation, since the minimum radial size X1 of the first gap 251 and the minimum radial size X3 of the third gap 253 are set to be larger than the maximum radial size X2 of the second gap 252, the subassembly 148 can be inserted into the coil arrangement 10 and the yoke 15 without interfering with the bobbin 11 and the yoke 15. Next, a punch 111, which is shown in FIG. 20, is used to plastically deform the other end part of the tubular portion 16 of the yoke 15 in the state where the second stationary core 30 contacts the yoke 15 in the axial direction to swage, i.e., to plastically deform the other end part of the tubular portion 16 against the first stationary core 25. In this way, the radially outer part of the first stationary core 25 is fixed to the tubular portion 16 of the yoke 15.

The operation of the linear solenoid 1 of the present embodiment is similar to that of the first embodiment. In a case where the bottom portion of the yoke does not have the recess (the hole having the bottom), the total magnetic attractive force may be reduced in the latter half of the stroke at the time of moving the movable core 40 toward the full stroke position (similar to the comparative example discussed with reference to the dotted line of FIG. 6). In contrast, in the case of the fifth embodiment, the total magnetic attractive force is not reduced in the latter half of the stroke (similar to the first embodiment discussed with reference to the solid line of FIG. 6).

As discussed above, in the linear solenoid 1 of the fifth embodiment, the bottom portion 17 of the yoke 15 includes the recess 18, which receives the part of the connecting portion 34 of the second stationary core 30 located on the bottom portion 17 side.

Therefore, the axial length of the magnetic flux conducting portion 42 of the movable core 40 can be increased by the amount, which corresponds to the amount of insertion of the second stationary core 30 into the recess 18 of the bottom portion 17 of the yoke 15. Thus, an axial extent of an overlapped area between the movable core 40 and the magnetic flux conducting portion 32 of the second stationary core 30 is increased in the latter half of the stroke of the movable core 40 at the time of moving the movable core 40 toward the full stroke position. In this overlapped area, an axial extent of the movable core 40 and an axial extent of the magnetic flux conducting portion 32 of the second stationary core 30 are overlapped with each other, and an axial extent of this overlapped area is referred to as the axial extent of the overlapped area. Thereby, the substantial change in the total magnetic attractive force caused by the change in the stroke of the movable core can be effectively limited without increasing the size of the linear solenoid 1.

Furthermore, in the fifth embodiment, the recess 18 is formed as the hole having the bottom 18*a*. Therefore, the required rigidity of the yoke 15 can be achieved.

Furthermore, in the fifth embodiment, the one end portion of the collar 45 is press fitted to the first annular projection 28, and the other end portion of the collar 45 is press fitted to the second annular projection 33. The collar 45 limits or prohibits movement of the first stationary core 25 and the second stationary core 30 relative to each other in both of the axial direction and the radial direction.

Therefore, the variations in the axial size of the air gap 47 can be reduced to limit the variations in the total magnetic attractive force.

Furthermore, the deviation between the axis of the first stationary core 25 and the axis of the second stationary core 30 can be limited. Thus, a radial force, i.e., a side force, which is exerted against the movable core 40 in the radial direction, can be reduced. Therefore, the magnetic attractive force can be stabilized, and the wearing of the bearing portion 26 and the bearing portion 31 at the time of axially sliding the shaft 35 can be reduced. Also, the coaxiality between the bearing portion 26 and the bearing portion 31 can be improved to smoothly slide the shaft 35.

In the fifth embodiment, at the time of assembling the linear solenoid 1, the collar 45 is press fitted to the first annular projection 28 and the second annular projection 33, and thereby the first stationary core 25, the second stationary core 30, the shaft 35 and the movable core 40 are integrally assembled.

Thereby, the assembling of the linear solenoid 1 is eased.

Furthermore, in the fifth embodiment, the collar 45 and the magnetic flux conducting portion 32 of the second stationary core 30 are clamped in the axial direction between bottom portion 17 of the yoke 15 and the first stationary core 25, so that the magnetic flux can be conducted between the bottom portion 17 of the yoke 15 and the magnetic flux conducting portion 32 of the second stationary core 30 in the axial direction.

As a result, even in the case where the radial location of the second stationary core and the radial location of the bottom portion of the yoke are deviated from each other due to the influence of the size variations among the individual products, the size of the air gap between the second stationary core and the bottom portion of the yoke can be kept generally constant. Therefore, it is possible to reduce the variations in the magnetic attractive force among the individual products.

Furthermore, in the fifth embodiment, the radially outer section 37 of the magnetic flux conducting portion 32 of the second stationary core 30 located on the bottom portion 17 side contacts the edge part 119 of the recess 18 of the bottom portion 17 of the yoke 15 in the axial direction.

Therefore, it is possible to increase the contact surface area between the second stationary core 30 and the bottom portion 17 of the yoke 15, and thereby it is possible to conduct the magnetic flux through the increased contact surface area between the second stationary core 30 and a bottom portion 17 of the yoke 15.

Furthermore, in the fifth embodiment, the minimum radial size X1 of the first gap 251 and the minimum radial size X3 of the third gap 253 are larger than the maximum radial size X2 of the second gap 252.

Therefore, at the time of assembling the linear solenoid 1, the subassembly 148 can be inserted into the coil arrangement 10 and the yoke 15 without interfering with the bobbin 11 and the yoke 15. That is, even in the case where the collar 45 limits the relative radial movement between the first stationary core 25 and the second stationary core 30, it is possible to limit the occurrence of assembling failure, which results from the mechanical interference of at least one of the first and second stationary cores 25, 30 with the yoke 15. Furthermore, it is not required to set the large radial clearance between the first stationary core 25 and the yoke 15 in view of the interference. Therefore, it is possible to reduce the size of the air gap between the first stationary core 25 and the yoke 15, and thereby it is possible to increase the total magnetic attractive force.

Furthermore, in the fifth embodiment, the first stationary core 25 is fitted to the other end part of the tubular portion 16 of the yoke 15, and the first stationary core 25 can conduct the magnetic flux relative to the tubular portion 16 in the radial direction.

Thus, even in the case where the axial position of the first stationary core 25 and the axial position of the tubular portion 16 of the yoke 15 vary from the product to product, the size of the radial air gap between the first stationary core 25 and the tubular portion 16 of the yoke 15 is substantially constant. Therefore, it is possible to reduce or minimize the variations in the magnetic attractive force among the products.

(Sixth Embodiment)

Figure 22:
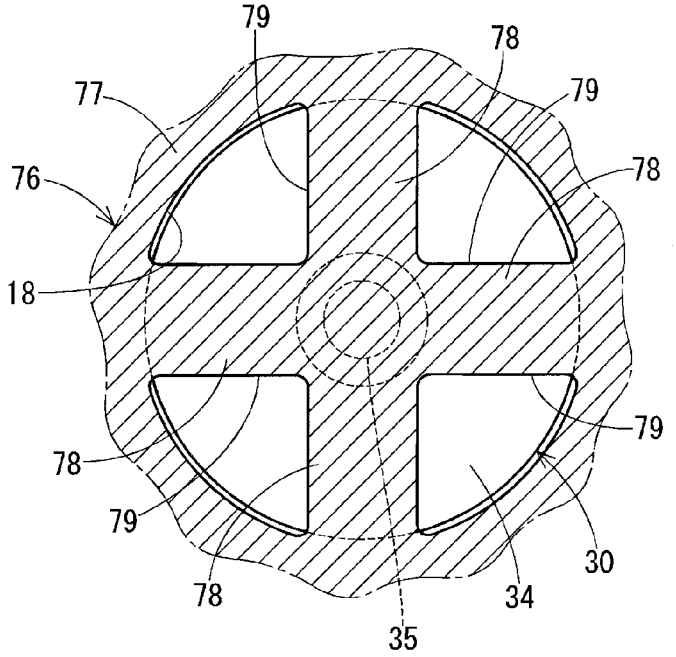
FIG. 22 is a cross sectional view taken along line XXII-XXII in FIG. 21.
Figure 21:
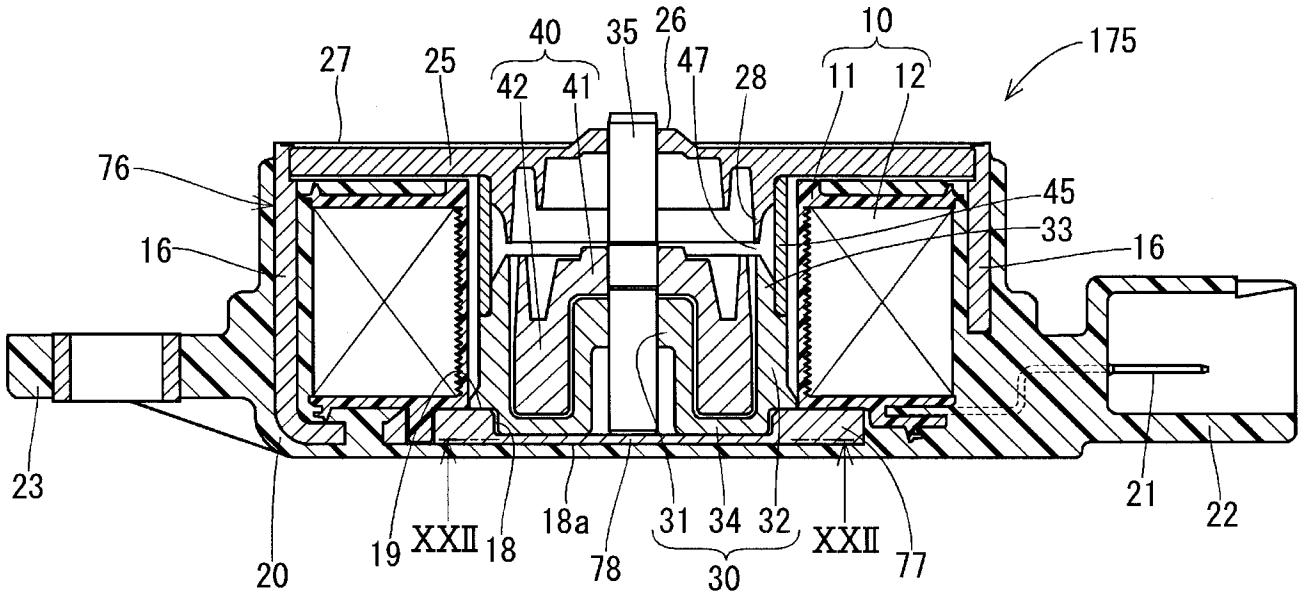
FIG. 21 is a cross-sectional view of a linear solenoid according to a sixth embodiment of the present disclosure.

A linear solenoid according to a sixth embodiment of the present disclosure will be described with reference to FIGS. 21 and 22. The sixth embodiment is a modification of the fifth embodiment. In the following discussion, differences of the sixth embodiment, which are different from the fifth embodiment, will be mainly discussed.

In the linear solenoid 175, the wall (the bottom wall) of the bottom 18*a* of the recess 18 of the bottom portion 77 of the yoke 76 has a plurality (four in this instance) of through-holes 79, which penetrate through the wall of the bottom 18*a* in the axial direction. The shaft 35 can contact a connecting portion 78, which is formed into a crisscross form and constitutes the bottom wall of the recess 18.

According to the sixth embodiment, the advantages, which are similar to those of the fifth embodiment, can be achieved. Furthermore, in the sixth embodiment, in a case where the recess 18, which has the bottom 18*a*, is formed by the press working process, the yoke 76 can be made lighter through use of the through-holes 79 in the bottom 18*a*. Thereby, the yoke 76 can be relatively easily manufactured. Furthermore, in the sixth embodiment, the rigidity of the peripheral edge part of the recess 18 of the yoke 76 is increased in comparison to a case where a through-hole axially extends through the yoke without forming the connecting portion 78 (see, for example, a yoke of an eighth embodiment discussed below with reference to FIG. 25).

(Seventh Embodiment)

Figure 23:
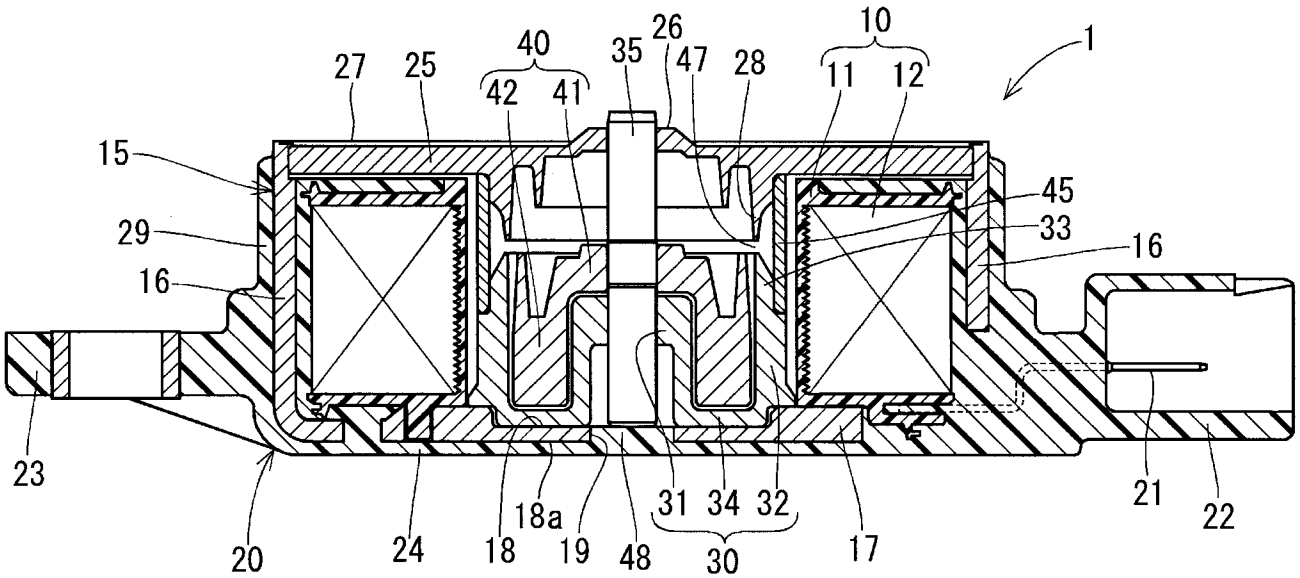
FIG. 23 is a cross-sectional view of a linear solenoid according to a seventh embodiment of the present disclosure, showing an operational state, in which a shaft is placed in an initial position.
Figure 24:
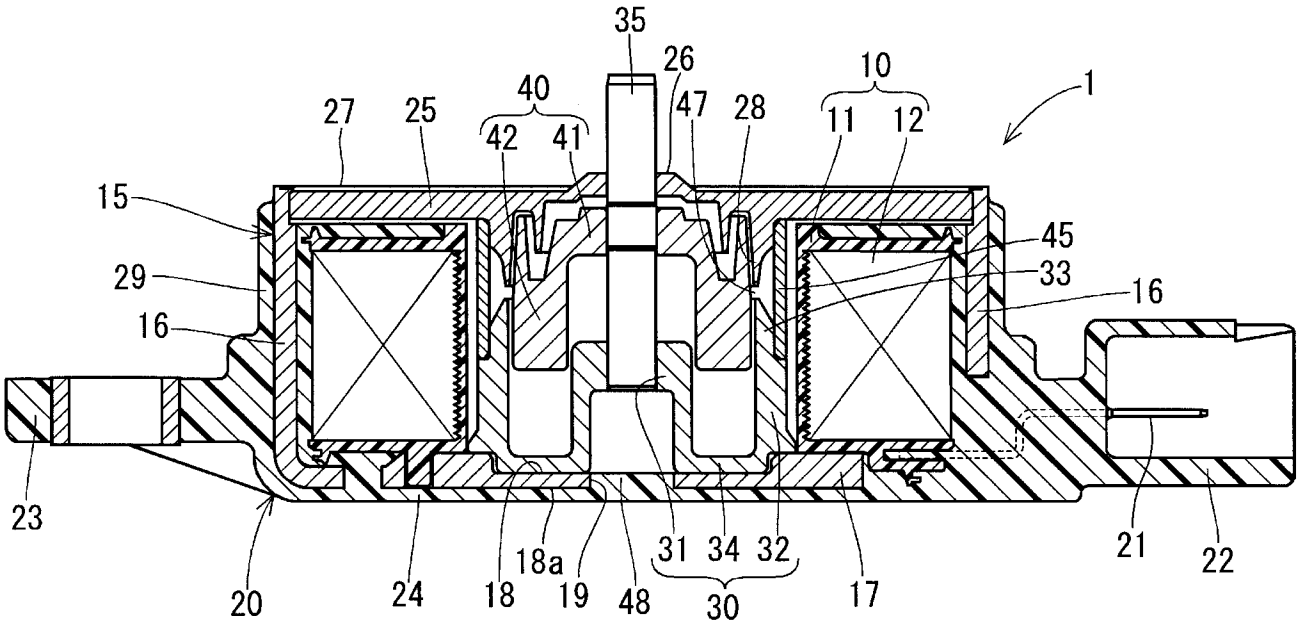
FIG. 24 is a cross-sectional view of the linear solenoid of the seventh embodiment, showing another operational state, in which the shaft is placed in a full stroke position.

A seventh embodiment of the present disclosure will be described with reference to FIGS. 23 and 24. The seventh embodiment is a modification of the fifth embodiment. In the following discussion, differences of the seventh embodiment, which are different from the fifth embodiment, will be mainly discussed.

In the linear solenoid 1 of the seventh embodiment, the second stationary core 30 includes the bearing portion 31, the magnetic flux conducting portion 32 and the connecting portion 34, which are formed integrally as the single integral member. The bearing portion 31 slidably supports the shaft 35. The magnetic flux conducting portion 32 is formed into the tubular form and is placed on the outer side of the bearing portion 31 in the radial direction, so that the magnetic flux conducting portion 32 is placed between the bearing portion 31 and the coil 12 in the radial direction. The connecting portion 34 connects between the radially inner section (see the radially inner section 36 of the fifth embodiment shown in FIG. 15) of the end part of the magnetic flux conducting portion 32 and the bearing portion 31 on the axial side where the bottom portion 17 of the yoke 15 is located. The magnetic flux conducting portion 32 also has the second annular projection 33, which projects toward the first annular projection 28 such that the air gap 47 is interposed between the second annular projection 33 and the first annular projection 28 in the axial direction.

The bottom portion 17 of the yoke 15 has the recess 18 and a through-hole 19. The connecting portion 34 of the second stationary core 30 is inserted into the recess 18. The through-hole 19 extends through the wall (the bottom wall) of the bottom 18*a* of the recess 18 in the axial direction. A cross-sectional area of the through-hole 19, which is measured in a plane perpendicular to the axial direction of the shaft 35, is set to include an entire projected area of an end surface of an end of the shaft 35 located on the bottom portion 17 side in a case where this projected area of the surface of the end of the shaft 35 is projected into the through-hole 19 in the axial direction. In other words, the cross-sectional area of the through-hole 19 is larger than a surface area of the end surface of the shaft 35 located on the side where the bottom portion 17 is placed. The through-hole 19 is coaxial with the shaft 35 and extends through the wall of the bottom 18*a* of the recess 18. An inner diameter of the through-hole 19 is smaller than an inner diameter of the recess 18 and is larger than an outer diameter of the shaft 35. Furthermore, the collar 45 and the magnetic flux conducting portion 32 of the second stationary core 30 are clamped between the bottom portion 17 of the yoke 15 and the first stationary core 25 in the axial direction. The radially outer section (see the radially outer section 37 of FIG. 15) of the magnetic flux conducting portion 32 of the second stationary core 30 contacts the peripheral edge part (see the peripheral edge part 119 of FIG. 15) of the recess 18 of the bottom portion 17 of the yoke 15 in the axial direction. The bottom portion 17 of the yoke 15 can conduct the magnetic flux to the magnetic flux conducting portion 32 of the second stationary core 30 in the axial direction.

The housing 20 is made of the resin material and includes a tubular portion 29 and a bottom portion 24. The tubular portion 16 of the yoke 15 is insert molded into the tubular portion 29, and the bottom portion 17 of the yoke 15 is insert molded into the bottom portion 24. The bottom portion 24 of the housing 20 is placed on a side of the bottom portion 17 of the yoke 15, which is opposite from the second stationary core 30 in the axial direction. The bottom portion 24 serves as a stopper (stopper means), against which the shaft 35 is abuttable. The bottom portion 24 includes a projection 48, which projects into the through-hole 19 in the axial direction. An outer diameter of the projection 48 is substantially the same as the inner diameter of the through-hole 19, and the projection 48 is coaxial with the shaft 35. A radially outer surface (an outer peripheral surface) of the projection 48 tightly contacts an inner surface (an inner peripheral surface) of the through-hole 19.

Next, operation of the linear solenoid 1 will be described.

When the coil 12 is energized, the movable core 40 is driven by the magnetic attractive force (the total magnetic attractive force), which is generated in response to the amount of magnetic flux that flows through the magnetic circuit, to drive the shaft 35 together with the movable core 40 toward the full stroke position against the urging force of the spring 110.

When the coil 12 is deenergized, the shaft 35 is driven to the initial position by the urging force of the spring 110 of the hydraulic pressure change valve 107 or vibration such that the shaft 35 contacts the projection 48 of the housing 20.

As discussed above, in the linear solenoid 1 of the seventh embodiment, the bottom portion 17 of the yoke 15 has the through-hole 19, which extends through the wall of the bottom 18*a* of the recess 18 in the axial direction and has the cross-sectional area, which is set to include the entire projected area of the end surface of the end of the shaft 35 located on the bottom portion 17 side. The inner diameter of the through-hole 19 is larger than the outer diameter of the shaft 35. The bottom portion 24 of the housing 20 made of the resin material is located on the side of the bottom portion 17 of the yoke 15, which is opposite from the second stationary core 30 in the axial direction. The bottom portion 24 of the housing 20 serves as the stopper (stopper means), against which the shaft 35 is abuttable.

Therefore, at the time of the cranking operation of the engine or at the time of the cleaning operation of the hydraulic pressure change valve 107 of the valve timing control apparatus 100, when the shaft 35 is moved by the external force or the vibration toward the initial position, the shaft 35 abuts against the projection 48 of the housing 20 made of the resin material. Therefore, the metal collision sound, which would be generated when the shaft 35 abuts against the yoke made of the metal material, is not generated, and it is possible to reduce the collision sound of the shaft 35.

Furthermore, in the seventh embodiment, the bottom portion 24 of the housing 20 has the projection 48, which projects into the through-hole 19.

Therefore, the collision force of the shaft 35, which is generated when the shaft 35 abuts against the projection 48, is absorbed by the yoke 15. Therefore, it is possible to increase the strength of the portion of the housing 20, against which the shaft 35 abuts.

Furthermore, in the seventh embodiment, the bottom portion 17 of the yoke 15 has the recess 18, into which the connecting portion 34 of the second stationary core 30 is inserted. The through-hole 19 extends through the wall of the bottom 18*a* of the recess 18 in the axial direction.

Therefore, similar to the fifth embodiment discussed with reference to FIGS. 13 to 20, the axial length of the magnetic flux conducting portion 42 of the movable core 40 can be increased by the amount, which corresponds to the amount of insertion of the second stationary core 30 into the recess 18 of the bottom portion 17 of the yoke 15. Therefore, the axial extent of the overlapped area between the movable core 40 and the magnetic flux conducting portion 32 of the second stationary core 30 is increased in the latter half of the stroke of the movable core 40 at the time of moving the movable core 40 toward the full stroke position. Thereby, the substantial change in the total magnetic attractive force caused by the change in the stroke of the movable core can be effectively limited without increasing the size of the linear solenoid 1. In the case where the recess 18, which is the hole having the bottom 18*a*, is formed by the press working process, the through-hole 19, which aids in the reduction of the weight, is also formed.

(Eighth Embodiment)

Figure 25:
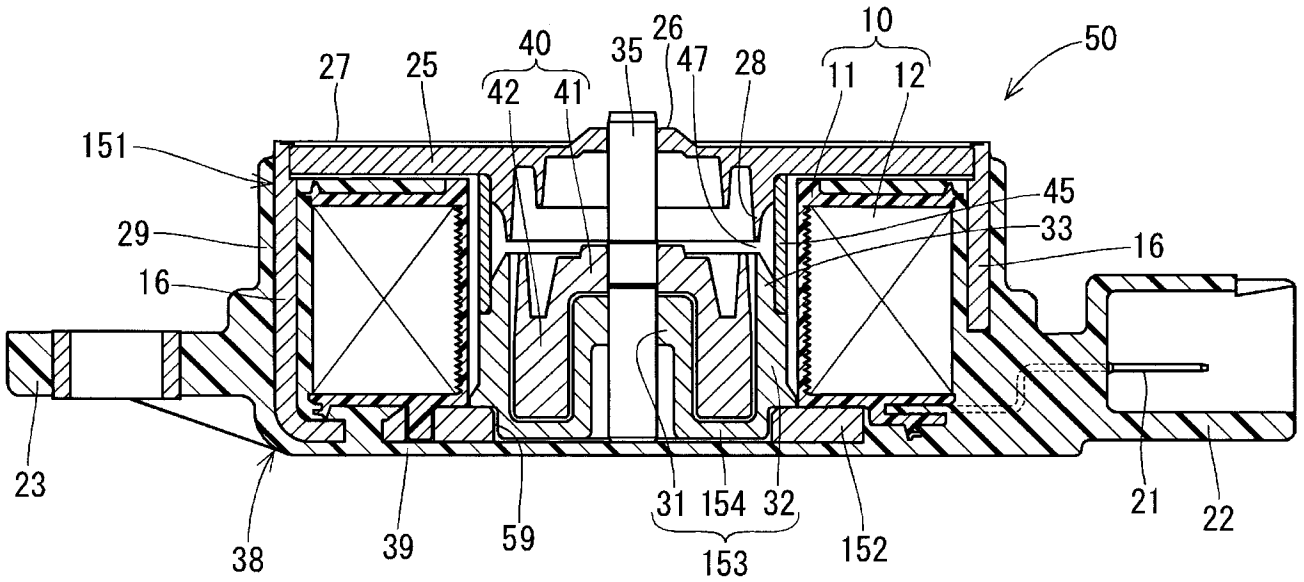
FIG. 25 is a cross-sectional view of a linear solenoid according to an eighth embodiment of the present disclosure.

A linear solenoid according to an eighth embodiment of the present disclosure will be described with reference to FIG. 25. The eighth embodiment is a modification of the seventh embodiment. In the following discussion, differences of the eighth embodiment, which are different from the seventh embodiment, will be mainly discussed.

In the linear solenoid 50, a bottom portion 152 of a yoke 151 has a through-hole 59. The through-hole 59 extends through a wall (a bottom wall) of the bottom portion 152 in the axial direction. A cross-sectional area of the through-hole 59, which is measured in a plane perpendicular to the axial direction of the shaft 35, is set to include an entire projected area of an end surface of an end of the connecting portion 154 of the second stationary core 153 located on the bottom portion 152 side in a case where this projected area of the end surface of the end of the connecting portion 154 is projected into the through-hole 59 in the axial direction. In other words, the cross-sectional area of the through-hole 59 is larger than a surface area of the end surface of the connecting portion 154 located on the bottom portion 152 side. The inner diameter of the through-hole 59 is larger than the outer diameter of the connecting portion 154, and the connecting portion 154 is inserted into the through-hole 59.

The bottom portion 39 of the housing 38 is placed on a side of the bottom portion 152 of the yoke 151, which is opposite from the second stationary core 153 in the axial direction. The bottom portion 39 of the housing 38 serves as a stopper (stopper means), against which the shaft 35 is abuttable.

According to the eighth embodiment, the advantages, which are similar to those of the seventh embodiment, can be achieved. Furthermore, in the eighth embodiment, the through-hole 59 extends through the wall (the bottom wall) of the bottom portion 152 in the axial direction. Therefore, the manufacturing of the yoke 151 can be made easier.

Furthermore, the axial extent of the overlapped area between the movable core 40 and the magnetic flux conducting portion 32 of the second stationary core 30 can be further increased in comparison to the seventh embodiment.

(Ninth Embodiment)

Figure 26:
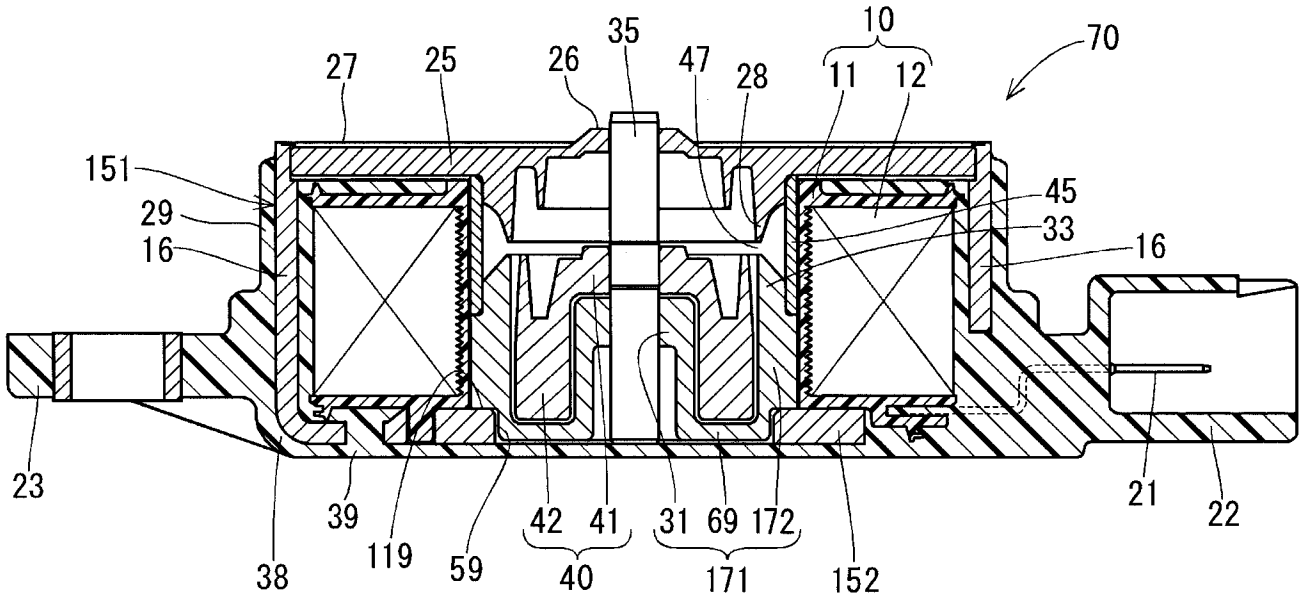
FIG. 26 is a cross-sectional view of a linear solenoid according to a ninth embodiment of the present disclosure.

A linear solenoid according to a ninth embodiment of the present disclosure will be described with reference to FIG. 26. The ninth embodiment is a modification of the eighth embodiment. In the following discussion, a difference of the ninth embodiment, which is different from the eighth embodiment, will be mainly discussed.

In the linear solenoid 70, the connecting portion 69 of the second stationary core 171 is inserted into the through-hole 59, and the magnetic flux conducting portion 172 of the second stationary core 171 has a constant radial size from an end part of the magnetic flux conducting portion 172, which is located on the bottom portion 152 side in the axial direction, to an axial intermediate part of the magnetic flux conducting portion 172. That is, the end part of the magnetic flux conducting portion 172, which is located on the bottom portion 152 side in the axial direction, is not configured to form the flange (see, for example, the radially outer section 37 of FIG. 15).

According to the ninth embodiment, the advantages, which are similar to those of the fifth embodiment and the eighth embodiment, can be achieved.

(Tenth Embodiment)

Figure 27:
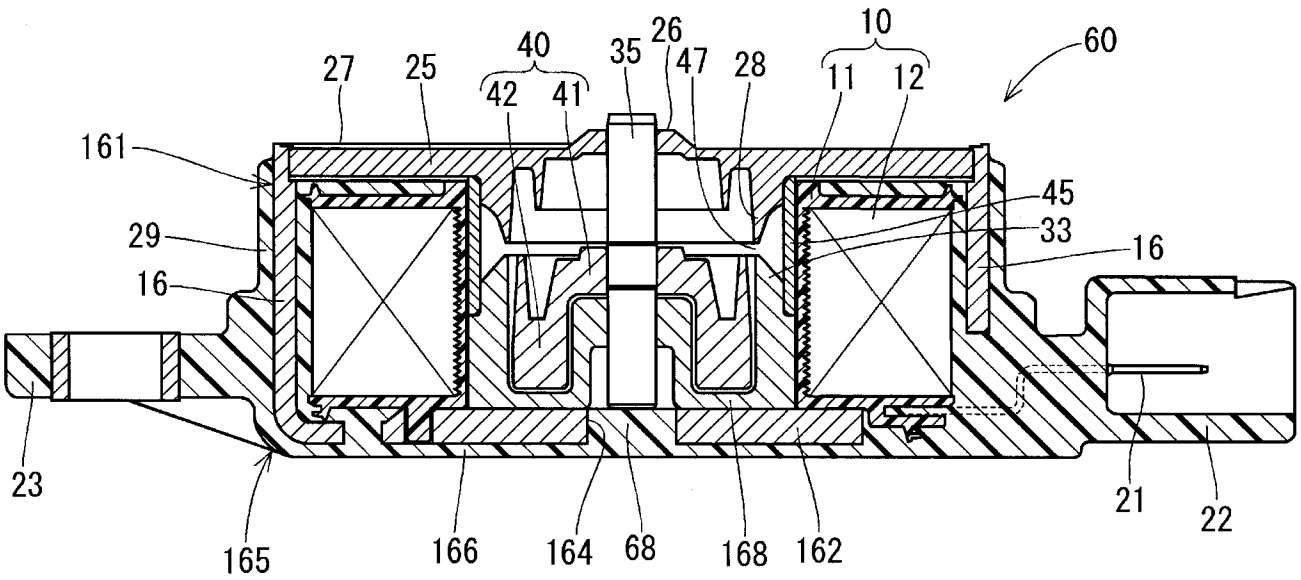
FIG. 27 is a cross-sectional view of a linear solenoid according to a tenth embodiment of the present disclosure.

A linear solenoid according to a tenth embodiment of the present disclosure will be described with reference to FIG. 27. The tenth embodiment is a modification of the ninth embodiment.

In the linear solenoid 60, the bottom portion 162 of the yoke 161 has a through-hole 164. A cross-sectional area of the through-hole 164, which is measured in a plane perpendicular to the axial direction of the shaft 35, is set to include the entire projected area of the end surface of the end of the shaft 35 located on the bottom portion 162 side in the case where this projected area of the end surface of the end of the shaft 35 is projected into the through-hole 164 in the axial direction. In other words, the cross-sectional area of the through-hole 164 is larger than the surface area of the end surface of the end of the shaft 35 located on the bottom portion 162 side. An inner diameter of the through-hole 164 is larger than the outer diameter of the shaft 35.

The bottom portion 166 of the housing 165 is placed on a side of the bottom portion 162 of the yoke 161, which is opposite from the second stationary core 168 in the axial direction. The bottom portion 166 of the housing 165 serves as a stopper (stopper means), against which the shaft 35 is abuttable. The bottom portion 166 has a projection 68, which projects into the through-hole 164 in the axial direction. An outer diameter of the projection 68 is substantially the same as an inner diameter of the through-hole 164, and the projection 68 is placed coaxially with the shaft 35.

In the tenth embodiment, similar to the seventh embodiment, it is possible to achieve the advantage of reducing the collision sound of the shaft 35 and the advantage of increasing the strength of the portion of the housing 165, against which the shaft 35 abuts.

(Eleventh Embodiment)

Figure 28:
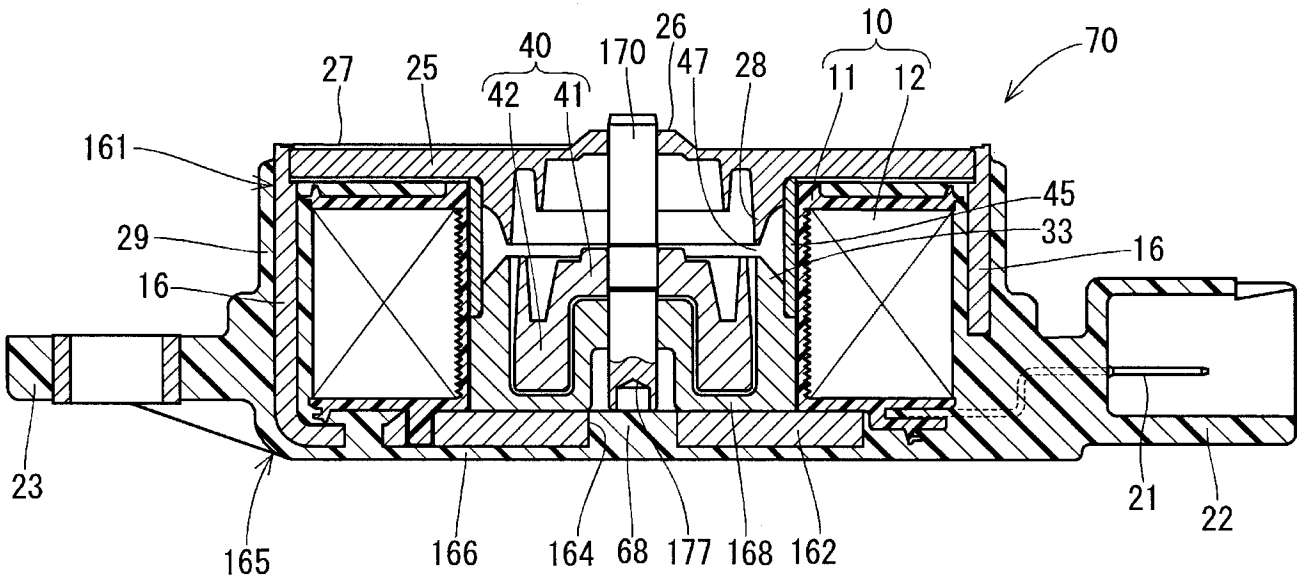
FIG. 28 is a cross-sectional view of a linear solenoid according to an eleventh embodiment of the present disclosure.

A linear solenoid according to an eleventh embodiment of the present disclosure will be described with reference to FIG. 28. The eleventh embodiment is a modification of the tenth embodiment.

In the linear solenoid 70, the shaft 170 has a first hole (a first blind hole) 177 having a bottom. The first hole 177 opens in an opposed surface of an end portion of the shaft 170, which is opposed to the projection 68 in the axial direction.

According to the eleventh embodiment, the advantages, which are similar to those of the tenth embodiment, can be achieved. Furthermore, in the eleventh embodiment, when the shaft 170 is urged to the initial position, the pressure is generated at the time of resisting the outflow of the air or the oil (fluid), which is present in the first hole 177, and this pressure provides a squeezing effect to damp, i.e., to reduce the collision force of the shaft 170 against the projection 68. Thereby, the collision sound can be further reduced.

(Twelfth Embodiment)

Figure 29:
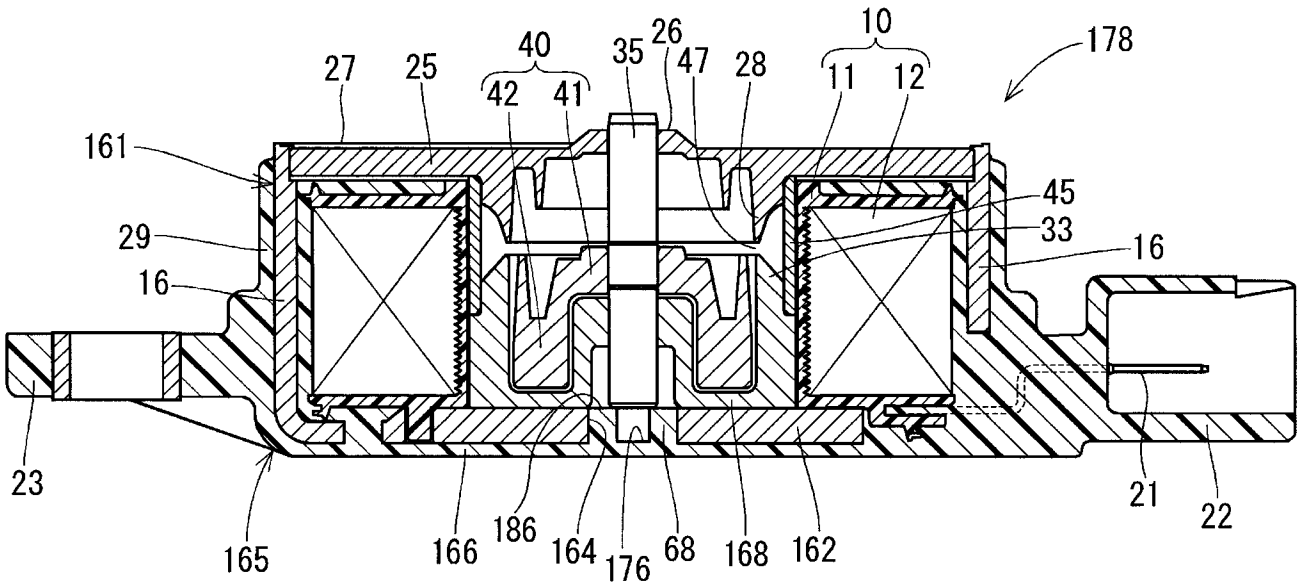
FIG. 29 is a cross-sectional view of a linear solenoid according to a twelfth embodiment of the present disclosure.

A linear solenoid according to a twelfth embodiment of the present disclosure will be described with reference to FIG. 29. The twelfth embodiment is a modification of the tenth embodiment.

In the linear solenoid 178, the projection 68 of the housing 165 has a contact surface 186, against which the shaft 35 is abuttable. A second hole (a second blind hole) 176 having a bottom is formed in the contact surface 186 of the projection 68. An inner diameter of the second hole 176 is smaller than the outer diameter of the shaft 35.

In the twelfth embodiment, similar to the eleventh embodiment, when the shaft 35 is urged to the initial position, the pressure is generated at the time of resisting the outflow of the air or the oil (fluid), which is present in the second hole 176, and this pressure provides the squeezing effect to damp, i.e., to reduce the collision force of the shaft 35 against the projection 68. Thereby, the collision sound can be further reduced.

(Thirteenth Embodiment)

Figure 30:
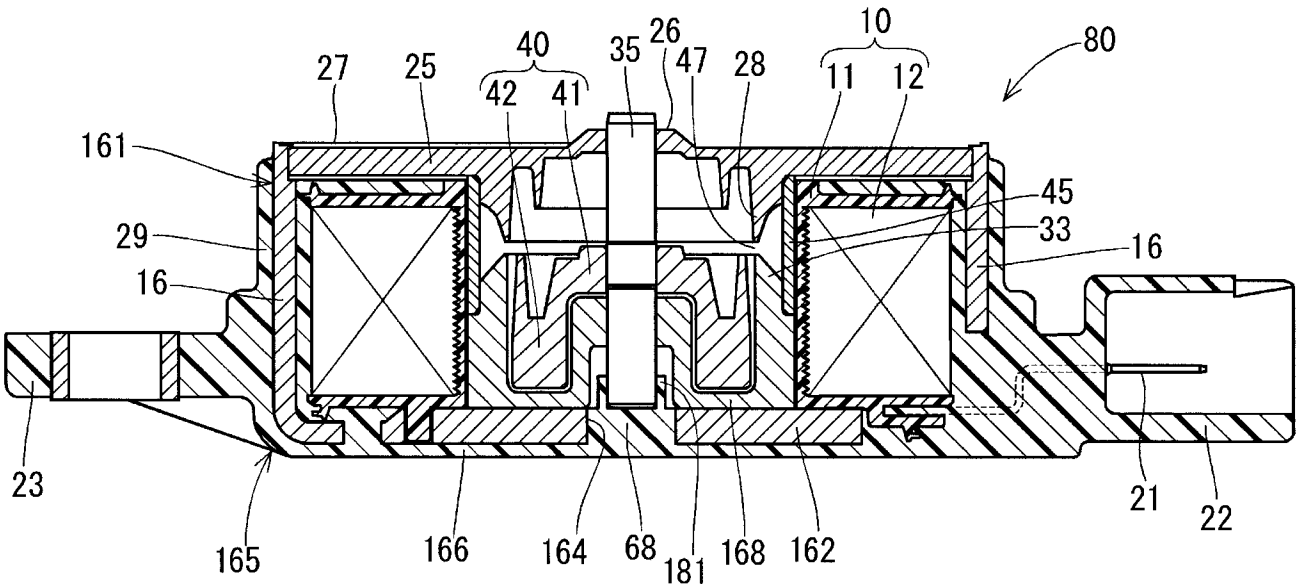
FIG. 30 is a cross-sectional view of a linear solenoid according to a thirteenth embodiment of the present disclosure.

A linear solenoid according to a thirteenth embodiment of the present disclosure will be described with reference to FIG. 30. The thirteenth embodiment is a modification of the tenth embodiment.

In the linear solenoid 80, the projection 68 of the housing 165 has a tubular projection 181. The tubular projection 181 projects toward the shaft 35 in the axial direction. The shaft 35 is insertable into an interior of the tubular projection 181, which is located radially inward of the tubular projection 181.

In the thirteenth embodiment, similar to the twelfth embodiment, when the shaft 35 is urged to the initial position, the pressure is generated at the time of resisting the outflow of the air or the oil (fluid), which is present in the interior of the tubular projection 181, and this pressure provides the squeezing effect to damp, i.e., to reduce the collision force of the shaft 35 against the projection 68. Thereby, the collision sound can be further reduced.

(Fourteenth Embodiment)

Figure 31:
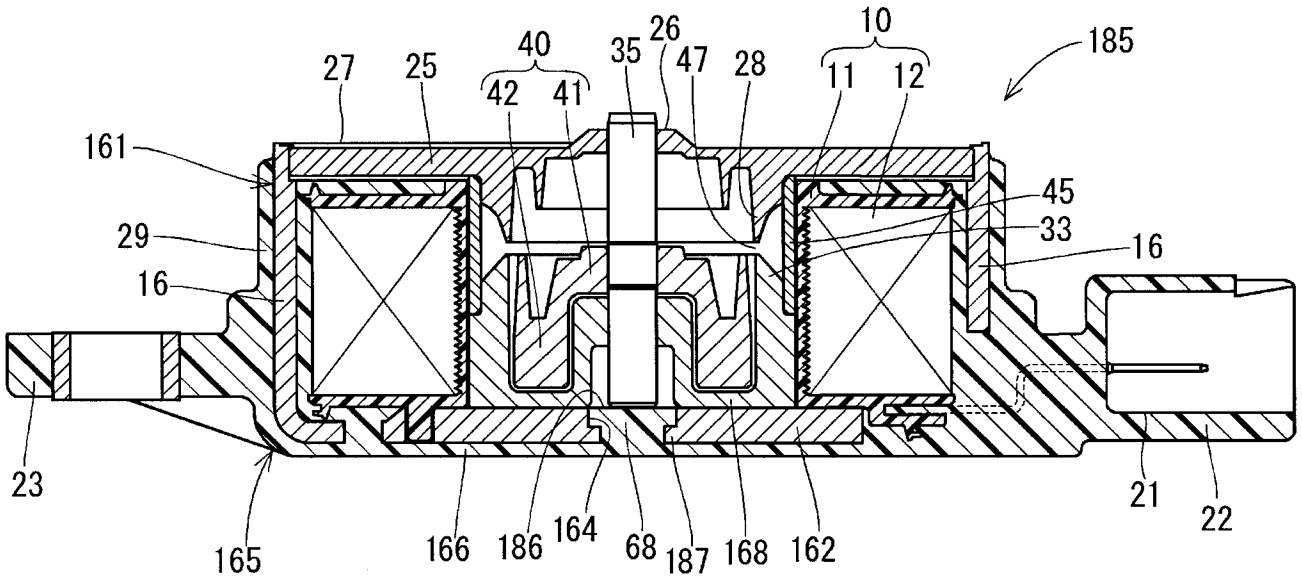
FIG. 31 is a cross-sectional view of a linear solenoid according to a fourteenth embodiment of the present disclosure.

A linear solenoid according to a fourteenth embodiment of the present disclosure will be described with reference to FIG. 31. The fourteenth embodiment is a modification of the tenth embodiment.

In the linear solenoid 185, the bottom portion 162 of the yoke 161 has an annular projection (also referred to as an annular protrusion or an annular flange) 187. The projection 68 of the bottom portion 166 of the housing 165 projects into the through-hole 164 of the bottom portion 162 of the yoke 161 in the axial direction, and the shaft 35 is abuttable against the contact surface 186 of the projection 68. The annular projection 187 radially inwardly projects from an end part of the through-hole 164, which is located on a side of the contact surface 186 that is opposite from the shaft 35 in the axial direction.

According to the fourteenth embodiment, the advantages, which are similar to those of the tenth embodiment, can be achieved. Furthermore, in the fourteenth embodiment, the collision force of the shaft 35, which is exerted at the time of abutment of the shaft 35 against the projection 68, is received by the annular projection 187 made of the metal material. Therefore, it is possible to increase the strength of the portion of the housing 165, against which the shaft 35 abuts.

(Fifteenth Embodiment)

Figure 32:
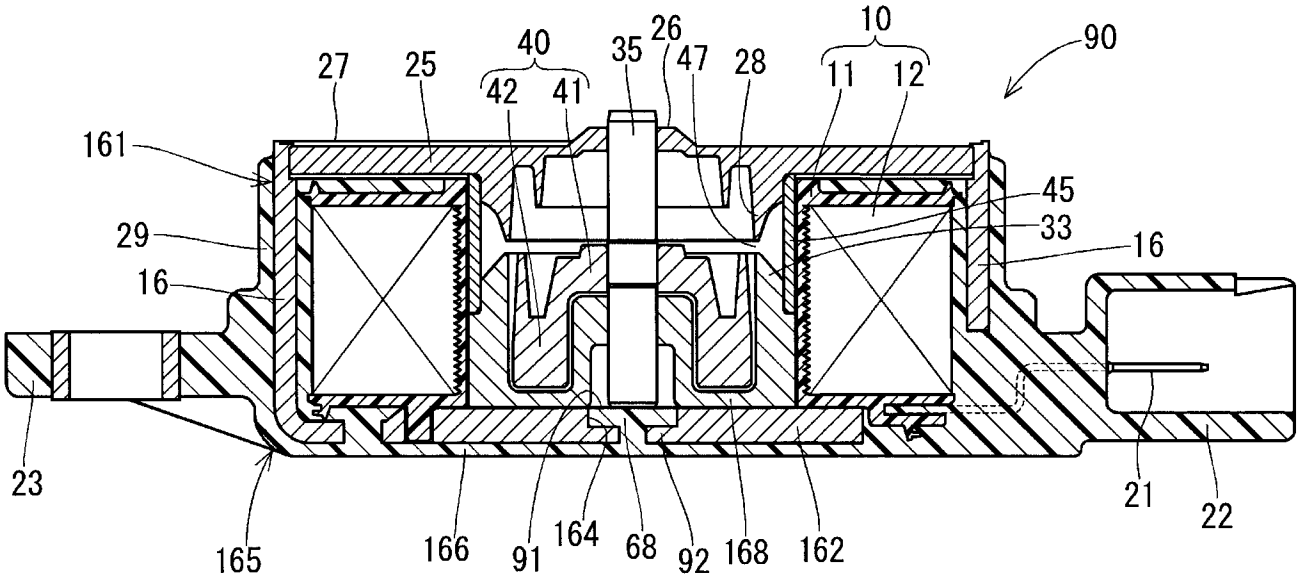
FIG. 32 is a cross-sectional view of a linear solenoid according to a fifteenth embodiment of the present disclosure.

A linear solenoid according to a fifteenth embodiment of the present disclosure will be described with reference to FIG. 32. The fifteenth embodiment is a modification of the fourteenth embodiment.

In the linear solenoid 90, the bottom portion 162 of the yoke 161 has an annular projection (annular flange) 92. The projection 68 of the bottom portion 166 of the housing 165 projects into the through-hole 164 of the bottom portion 162 of the yoke 161, and the shaft 35 is abuttable against a contact surface 91 of the projection 68. The annular projection 92 radially inwardly projects from an end part of the through-hole 164, which is located on a side of the contact surface 91 that is opposite from the shaft 35 in the axial direction. An inner diameter of the annular projection 92 is smaller than the outer diameter of the shaft 35.

According to the fifteenth embodiment, the advantages, which are similar to those of the fourteenth embodiment, can be achieved. Furthermore, in the fifteenth embodiment, a radial extent of the annular projection 92 and a radial extent of the shaft 35 overlap with each other. Thereby, the annular projection 92 can effectively receive the collision force of the shaft 35 when the shaft 35 abuts against the projection 68. Therefore, it is possible to further increase the strength of the portion of the housing 165, against which the shaft 35 abuts, in comparison to the fourteenth embodiment, in which the radial extent of the annular projection 187 does not overlap with the radial extent of the shaft 35.

Now, modifications of the first to fourth embodiments will be described.

In a modification of the above embodiment(s), the number of the tapered surface(s) of the first stationary core opposed to the movable core may be increased to three or more.

In another modification of the above embodiment(s), the number of the tapered surface(s) of the movable core opposed to the first stationary core may be increased to two or more.

In another modification of the above embodiment(s), in a case where the first stationary core is fitted into the tubular portion of the yoke, the fixation between the first stationary core and the yoke is not limited to the swaging and may be made by, for example, press-fitting.

It is not necessary to fit the first stationary core into the tubular portion of the yoke. In the case where the first stationary core is not fitted into the tubular portion of the yoke, the fixation between the first stationary core and the yoke may be made by, for example, crimping.

In another modification of the above embodiment(s), the magnetic flux may be conducted between the first stationary core and the yoke in the axial direction. In such a case, the range of the relative movement (the relatively movable range) between the first stationary core and the yoke in the radial direction may be set to be larger than the range of the relative movement (the relatively movable range) between the second stationary core and the yoke in the radial direction.

In another modification of the above embodiment(s), the first stationary core may be constructed such that the bearing portion and the fixing portion are formed separately and are thereafter assembled together.

In another modification of the above embodiment(s), the magnetic flux may be conducted between the second stationary core and the yoke in the radial direction. In this case, the second stationary core and the yoke may be fixed together by, for example, press-fitting.

In another modification of the above embodiment(s), the annular projection may be eliminated from at least one of the first stationary core and the second stationary core. That is, it is only required to provide the air gap between the first stationary core and the second stationary core.

In another modification of the above embodiment(s), one or all of the first stationary core, the second stationary core and the yoke may have a cross section that is not circular and may have a notch in a circumferential portion thereof.

In another modification of the above embodiment(s), the collar may be formed into another form that is other than the tubular form. The configuration of the collar may be, for example, a rod form or a plate form as long as the collar can limit the relative movement of the first stationary core and the second stationary core toward each other.

In another modification of the above embodiment(s), the collar may be fitted to the first stationary core and the second stationary core such that the collar is radially movable relative to the first stationary core and the second stationary core. In this way, the collar does not need to integrally assemble the first stationary core, the second stationary core, the shaft and the movable core together.

In another modification of the above embodiment(s), the liner solenoid is not necessarily implemented as the drive device of the hydraulic pressure change valve and may be implemented as a drive device of various other functional apparatuses, each of which includes a driven member that is driven to reciprocate.

In another modification of the above embodiment(s), the collar may be engaged with the first stationary core and the second stationary core rather than using the press-fitting. In this way, the collar does not need to integrally assemble the first stationary core, the second stationary core, the shaft and the movable core.

The present disclosure is not limited the above embodiments and modifications thereof. That is, the above embodiments and modifications thereof may be modified in various ways without departing from the spirit and scope of the present disclosure.

What is claimed is:

1. A linear solenoid comprising:

a coil that is formed into an annular form;

a shaft that is placed on an inner side of the coil in a radial direction and is configured to reciprocate in an axial direction;

a first stationary core that includes:

a first bearing portion, which slidably supports one end portion of the shaft; and a fixing portion, which outwardly extends from the first bearing portion in the radial direction, wherein the first bearing portion and the fixing portion are seamlessly and integrally formed;

a second stationary core that includes:

a second bearing portion, which slidably supports the other end portion of the shaft that is opposite from the one end portion of the shaft in the axial direction;

a magnetic flux conducting portion, which is configured into a tubular form and is placed between the second bearing portion and the coil in the radial direction, wherein an air gap is interposed between the magnetic flux conducting portion and the first stationary core in the axial direction; and a connecting portion, which connects between one end part of the second bearing portion and one end part of the magnetic flux conducting portion on an axial side that is opposite from the first stationary core in the axial direction;

a yoke that is located on an outer side of the coil in the radial direction and magnetically couples between the first stationary core and the second stationary core; and a movable core that includes:

a holding portion, which securely holds the shaft at a corresponding location that is located between the first bearing portion and the second bearing portion in the axial direction; and a magnetic flux conducting portion that is placed between the second bearing portion and the magnetic flux conducting portion of the second stationary core in the radial direction and extends from the holding portion in the axial direction toward the connecting portion of the second stationary core, wherein:

when the coil is energized, the movable core is moved toward the first stationary core and conducts a magnetic flux between the first stationary core and the second stationary core through the movable core;

a radially outer part of the first bearing portion has an axial end surface, which is axially opposed to the movable core;

the first bearing portion has a through-hole, which receives the shaft;

one axial end of the through-hole of the first bearing portion, which is located on the movable core side, has a peripheral edge that is placed at a corresponding axial position; and the corresponding axial position of the peripheral edge of the axial end of the through-hole is on an axial side of the axial end surface of the radially outer part, which is opposite from the movable core in the axial direction.

2. The linear solenoid according to claim 1, wherein the first bearing portion of the first stationary core has a recess, which is configured to axially receive at least a part of the holding portion of the movable core when the movable core is moved toward the first stationary core.

3. The linear solenoid according to claim 2, wherein a radially inner surface of the recess of the first stationary core is tapered to have a progressively increasing inner diameter, which progressively increases in the axial direction toward the movable core.

4. The linear solenoid according to claim 3, wherein:

an end part of the holding portion of the movable core, which is located on the first stationary core side in the axial direction, has a radially outer surface; and the radially outer surface of the end part of the holding portion is generally parallel to the axial direction or is tapered to have a progressively decreasing outer diameter, which progressively decreases in the axial direction toward the first stationary core.

5. The linear solenoid according to claim 4, wherein:

the radially outer surface of the end part of the holding portion is tapered to have the progressively decreasing outer diameter, which progressively decreases in the axial direction toward the first stationary core; and the radially outer surface of the end part of the holding portion is opposed to the radially inner surface of the recess of the first stationary core.

6. The linear solenoid according to claim 4, wherein the radially outer surface of the end part of the holding portion is one of a plurality of radially outer surfaces, each of which is formed in the end part of the holding portion and is generally parallel to the axial direction or is tapered to have the corresponding progressively decreasing outer diameter that progressively decreases in the axial direction toward the first stationary core.

7. The linear solenoid according to claim 3, wherein the radially inner surface of the recess of the first stationary core is one of a plurality of radially inner surfaces, each of which is formed in the recess of the first stationary core and is tapered to have the corresponding progressively increasing inner diameter that progressively increases in the axial direction toward the movable core.

8. The linear solenoid according to claim 1, wherein the first bearing portion projects in the axial direction relative to the fixing portion on the axial side, which is opposite from the movable core.

9. The linear solenoid according to claim 8, wherein an end part of the first bearing portion of the first stationary core, which is opposite from the movable core in the axial direction, has a radially outer surface, which is tapered to have a progressively increasing outer diameter that progressively increases in the axial direction toward the movable core.

10. The linear solenoid according to claim 1, wherein:

the first bearing portion and the fixing portion are integrally and seamlessly formed from a magnetic metal material; and the first bearing portion directly and slidably contacts the shaft.

11. The linear solenoid according to claim 1, wherein the yoke includes:

a tubular portion that is placed on the outer side of the coil in the radial direction and securely holds the first stationary core; and a bottom portion that is formed integrally with one end part of the tubular portion, which is located on an axial side where the second stationary core is located, wherein the bottom portion has a hole, which receives at least a part of the second stationary core.

12. The linear solenoid according to claim 1, further comprising a stopper that is made of a resin material and is placed on a side of the yoke, which is opposite from the second stationary core in the axial direction, wherein the shaft is abuttable against the stopper.

13. A linear solenoid comprising:

a coil that is formed into an annular form;

a first stationary core that is placed on one side of the coil in an axial direction;

a second stationary core that is placed on the other side of the coil, which is opposite from the one side of the coil in the axial direction, wherein an air gap is interposed between the first stationary core and the second stationary core in the axial direction;

a yoke that is located on an outer side of the coil in a radial direction and magnetically couples between the first stationary core and the second stationary core;

a shaft that is placed on an inner side of the air gap in the radial direction and is slidably supported by the first stationary core and the second stationary core, wherein the shaft is configured to reciprocate in the axial direction between an initial position, which is located on a side where the second stationary core is placed, and a full stroke position, which is located on a side where the first stationary core is placed;

a movable core that is fixed to the shaft at a corresponding location, which is located between the first stationary core and the second stationary core in the axial direction, wherein when the coil is energized, the movable core is moved together with the shaft in the axial direction toward the full stroke position to a position located on the inner side of the air gap in the radial direction and conducts a magnetic flux between the first stationary core and the second stationary core through the movable core; and a non-magnetic member that is held between the first stationary core and the second stationary core and limits relative movement between the first stationary core and the second stationary core toward each other, wherein the yoke includes:

a tubular portion that is placed on an outer side of the coil in the radial direction and securely holds the first stationary core; and a bottom portion that is formed integrally with one end part of the tubular portion, which is located on an axial side where the second stationary core is located, wherein the bottom portion has a hole, which receives at least a part of the second stationary core, wherein the second stationary core includes:

a bearing portion that slidably supports the shaft;

a magnetic flux conducting portion that is formed into a tubular form and is placed on an outer side of the bearing portion in the radial direction, wherein the air gap is interposed between the magnetic flux conducting portion and the first stationary core in the axial direction; and a connecting portion that is received in the hole and connects between the bearing portion and a radially inner section of an end part of the magnetic flux conducting portion, which is axially placed on a side where the bottom portion is located;

the bottom portion forms a peripheral edge part, which extends along an inner peripheral edge of the hole of the bottom portion and radially outwardly extends from the inner peripheral edge of the hole of the bottom portion; and a radially outer section of the end part of the magnetic flux conducting portion, which is opposite from the radially inner section in the radial direction, contacts the peripheral edge part of the hole of the bottom portion in the axial direction.

14. The linear solenoid according to claim 13, wherein the bottom portion of the yoke is configured to conduct the magnetic flux between the bottom portion of the yoke and the second stationary core in the axial direction.

15. The linear solenoid according to claim 13, wherein:

the first stationary core is fitted into the other end part of the tubular portion of the yoke, which is opposite from the one end part of the tubular portion in the axial direction; and the first stationary core is configured to conduct the magnetic flux between the first stationary core and the tubular portion of the yoke in the radial direction.

16. The linear solenoid according to claim 13, wherein a minimum radial size of a first gap, which is formed between an inner surface of the hole and the second stationary core in the radial direction, is larger than a maximum radial size of a second gap, which is formed between the tubular portion of the yoke and the first stationary core in the radial direction.

17. The linear solenoid according to claim 13, wherein the hole is a hole that has a bottom.

18. The linear solenoid according to claim 17, wherein a wall of the bottom of the hole has a through-hole, which extends through the wall of the bottom in the axial direction.

19. The linear solenoid according to claim 13, wherein the hole is a through-hole that extends through the bottom portion of the yoke.

20. The linear solenoid according to claim 13, wherein:

the peripheral edge part of the hole of the bottom portion has a contact surface, which extends in a direction perpendicular to the axial direction; and the radially outer section of the end part of the magnetic flux conducting portion contacts the contact surface of the peripheral edge part of the hole of the bottom portion in the axial direction.

21. A linear solenoid comprising:

a coil that is formed into an annular form;

a first stationary core that is placed on one side of the coil in an axial direction;

a second stationary core that is placed on the other side of the coil, which is opposite from the one side of the coil in the axial direction, wherein an air gap is interposed between the first stationary core and the second stationary core in the axial direction;

a yoke that magnetically couples between the first stationary core and the second stationary core, wherein the yoke includes a tubular portion, which is located on an outer side of the coil in a radial direction, and a bottom portion, which is formed integrally with one end part of the tubular portion located on a side where the second stationary core is placed;

a shaft that is placed on an inner side of the air gap in the radial direction and is slidably supported by the first stationary core and the second stationary core, wherein the shaft is configured to reciprocate in the axial direction between an initial position, which is located on a side where the second stationary core is placed, and a full stroke position, which is located on a side where the first stationary core is placed;

a movable core that is fixed to the shaft at a corresponding location, which is located between the first stationary core and the second stationary core in the axial direction, wherein when the coil is energized, the movable core is moved together with the shaft in the axial direction toward the full stroke position to a position located on the inner side of the air gap in the radial direction and conducts a magnetic flux between the first stationary core and the second stationary core through the movable core, and the bottom portion of the yoke has a through-hole that has a cross-sectional area, which is larger than a surface area of an end surface of the shaft located on a side where the bottom portion is placed; and a stopper that is made of a resin material and is placed on a side of the bottom portion of the yoke, which is opposite from the second stationary core in the axial direction, wherein the shaft is abuttable against the stopper.

22. The linear solenoid according to claim 21, wherein the stopper includes a projection, which projects into the through-hole.

23. The linear solenoid according to claim 21, where the stopper is a part of a housing, which is molded from the resin material, and the yoke is insert molded in the housing.

24. The linear solenoid according to claim 21, wherein:

the bottom portion of the yoke has a recess, which is recessed toward the stopper and has an inner diameter, which is larger than an inner diameter of the through-hole;

the recess receives at least a portion of the second stationary core; and the through-hole extends through a bottom wall of the recess.

25. The linear solenoid according to claim 21, wherein at least a portion of the second stationary core is inserted into the through-hole.

26. The linear solenoid according to claim 21, wherein the shaft has a first blind hole in the end surface of the shaft, which is located on the side where the stopper is placed.

27. The linear solenoid according to claim 21, wherein:

the stopper has a second blind hole that is formed in a contact surface of the stopper, against which the shaft is abuttable; and an inner diameter of the second blind hole is smaller than an outer diameter of the shaft.

28. The linear solenoid according to claim 21, wherein:

the stopper includes a tubular projection, which projects toward the shaft; and the shaft is insertable into an interior of the tubular projection.

29. The linear solenoid according to claim 21, wherein the bottom portion of the yoke includes an annular projection, which radially projects into the through-hole of the bottom portion at an end part of the through-hole, which is located on a side of the contact surface that is opposite from the shaft in the axial direction.

30. The linear solenoid according to claim 29, wherein an inner diameter of the annular projection is smaller than an outer diameter of the shaft.

* * * * *